US009305432B2

(12) United States Patent
Mullins et al.

(10) Patent No.: US 9,305,432 B2
(45) Date of Patent: Apr. 5, 2016

(54) ELECTRONIC GAMING DEVICE WITH SCRIPTED FUNCTIONALITY

(71) Applicant: Cadillac Jack, Inc., Duluth, GA (US)

(72) Inventors: Brendan Michael Mullins, Alpharetta, GA (US); Christopher James Weitzen, Atlanta, GA (US); Nathan Alan Poulisse, Lawrenceville, GA (US); Donald James Rollo, Dacula, GA (US); Dmitry M. Gerenrot, Alpharetta, GA (US); Steven Joseph Tongate, Avondale Estates, GA (US)

(73) Assignee: Cadillac Jack, Inc., Duluth, GA (US)

( * ) Notice: Subject to any disclaimer, the term of this patent is extended or adjusted under 35 U.S.C. 154(b) by 87 days.

(21) Appl. No.: 13/628,295

(22) Filed: Sep. 27, 2012

(65) Prior Publication Data

US 2014/0087823 A1 Mar. 27, 2014

(51) Int. Cl.
*G07F 17/32* (2006.01)

(52) U.S. Cl.
CPC ..... *G07F 17/326* (2013.01)

(58) Field of Classification Search
CPC ..... G06F 17/326
USPC ..... 463/22
See application file for complete search history.

(56) References Cited

U.S. PATENT DOCUMENTS

| | | | | | |
|---|---|---|---|---|---|
| 4,448,419 | A * | 5/1984 | Telnaes | 463/21 |
| 4,856,787 | A * | 8/1989 | Itkis | 273/237 |
| 5,380,008 | A * | 1/1995 | Mathis et al. | 463/18 |
| 5,456,465 | A * | 10/1995 | Durham | 463/21 |
| 5,511,784 | A * | 4/1996 | Furry et al. | 273/143 R |
| 6,537,150 | B1 * | 3/2003 | Luciano et al. | 463/16 |
| 2015/0099568 | A1 * | 4/2015 | Elias | G07F 17/34 463/20 |

* cited by examiner

*Primary Examiner* — Corbett B Coburn
(74) *Attorney, Agent, or Firm* — Weide & Miller, Ltd.

(57) ABSTRACT

Examples disclosed herein relate to systems, devices, and methods, which may receive wagers on one or more paylines. The systems, devices, and methods may determine a winning outcome and/or a losing outcome. The systems, devices, and methods may determine one or more key values. The systems and methods may determine a scripted scenario based on the determined one or more key values. The systems and methods may display one or more presentations based on the determined scripted scenario. The scripted scenario may utilize symbols, characters, and/or other gaming objects.

20 Claims, 17 Drawing Sheets

FIG. 8

800

| ITEM LIST (802) | VISUAL_ELEMENT (804) | MULTIPLIER (806) | NORMALIZED_BET (808) |
|---|---|---|---|
| 0 | RED WEAPON | 1 | |
| 1 | RED WEAPON | 3 | |
| 2 | RED WEAPON | 5 | |
| 3 (807) | RED WEAPON | 6 (811) | |
| 4 (809) | GREEN WEAPON | 1 | |
| 5 | GREEN WEAPON | 3 | |
| 6 | GREEN WEAPON | 5 | |
| 7 | GREEN WEAPON | 6 | |
| 8 | BLUE WEAPON | 1 | |
| 9 (813) | BLUE WEAPON | 3 (817) | |
| 10 (815) | BLUE WEAPON | 5 | |
| 11 | BLUE WEAPON | 6 | |
| 12 | BONUS MULTIPLIER | 3 | |
| 13 | BONUS MULTIPLIER | 5 | |
| 14 | BONUS MULTIPLIER | 6 | |
| 15 | RED PIRATE | | 5 |
| 16 (819) | RED PIRATE | | 10 (823) |
| 17 (821) | RED PIRATE | | 15 |
| 18 | GREEN PIRATE | | 5 |
| 19 | GREEN PIRATE | | 15 |
| 20 | GREEN PIRATE | | 25 |
| 21 | BLUE PIRATE | | 5 |
| 22 (825) | BLUE PIRATE | | 35 (829) |
| 23 (827) | BLUE PIRATE | | 65 |
| 24 | WHAMMY PIRATE | | |
| 25 | ENDING PIRATE | | |

FIG. 9

900

902 904 906 908 910 912 914 916

920
```
<!-- Weapons of type A -->
<SCRIPTELEMENT index="0"  type="X" position="A" prize="1"/>
<SCRIPTELEMENT index="1"  type="Y" position="B" prize="2"/>
<SCRIPTELEMENT index="2"  type="Z" position="C prize="3"/>
<SCRIPTELEMENT index="3"  type="A" position="D" prize="4"/>
```

922
```
<!-- Weapons of type B -->
<SCRIPTELEMENT index="4"  type="B" position="E" prize="5"/>
<SCRIPTELEMENT index="5"  type="B" position="A" prize="3"/>
<SCRIPTELEMENT index="6"  type="C" position="G" prize="9"/>
<SCRIPTELEMENT index="7"  type="D" position="1F prize="12"/>
```

924
```
<!-- Weapons of type C -->
<SCRIPTELEMENT index="8"  type="U" position="AA" prize="1001"/>
<SCRIPTELEMENT index="9"  type="R" position="AZ" prize="10"/>
<SCRIPTELEMENT index="10" type="V" position="AAA" prize="7"/>
<SCRIPTELEMENT index="11" type="A" position="ABA" prize="2567"/>
```

926
```
<!-- Overall bonus multipliers -->
<SCRIPTELEMENT index="12" type="ZZ" position="A1A" prize="A1"/>
<SCRIPTELEMENT index="13" type="AB" position="1CB" prize="1A"/>
<SCRIPTELEMENT index="14" type="ABC" position="10" prize="1BC"/>
```

928
```
<!-- Pirates of color A -->
<SCRIPTELEMENT index="15" type="1RT" position="A" prize="A"/>
<SCRIPTELEMENT index="16" type="RT1" position="ACB" prize="B"/>
<SCRIPTELEMENT index="17" type="R1T" position="ZA" prize="C"/>
```

930
```
<!-- Pirates of color B -->
<SCRIPTELEMENT index="18" type="1" position="7" prize="AA"/>
<SCRIPTELEMENT index="19" type="2" position="10" prize="BB"/>
<SCRIPTELEMENT index="20" type="3" position="22" prize="CC"/>
```

932
```
<!-- Pirates of color C -->
<SCRIPTELEMENT index="21" type="^" position="+" prize="$"/>
<SCRIPTELEMENT index="22" type="~" position="|" prize="*"/>
<SCRIPTELEMENT index="23" type="-" position="?" prize="%"/>
```

ELECTRONIC GAMING DEVICE WITH SCRIPTED FUNCTIONALITY

FIELD

The subject matter disclosed herein relates to an electronic gaming device. More specifically, the disclosure relates to an electronic gaming device, which provides gaming functionality relating to scripted scenarios. Further, the disclosure relates to mapping these scripted scenarios to triggering events (e.g., winning events, etc.).

INFORMATION

The gaming industry has numerous casinos located both worldwide and in the United States. A client of a casino or other gaming entity can gamble via various games of chance. For example, craps, roulette, baccarat, blackjack, and electronic games (e.g., a slot machine) where a person may gamble on an outcome.

Paylines of an electronic gaming device (e.g., a slot machine) are utilized to determine when predetermined winning symbol combinations are aligned in a predetermined pattern to form a winning combination. A winning event occurs when the player successful matches the predetermined winning symbols in one of the predetermined patterns. A new way of delivering game play includes providing more than one, a few, and/or a plurality of different scripted scenarios for a triggering event (e.g., winning event, etc.). These scripted scenarios may increase the excitement of game play because there would be more than one presentation (e.g., audio and visual) for each triggering event (e.g., winning event, etc.). These scripted scenarios may reduce the redundancy of having the same presentation packages presented to the player.

BRIEF DESCRIPTION OF THE FIGURES

Non-limiting and non-exhaustive examples will be described with reference to the following figures, wherein like reference numerals refer to like parts throughout the various figures.

FIG. 8 is an illustration of scripted scenario building blocks, according to one embodiment.

FIG. 9 is another illustration of scripted scenario building blocks, according to one embodiment.

DETAILED DESCRIPTION

Figure 1:
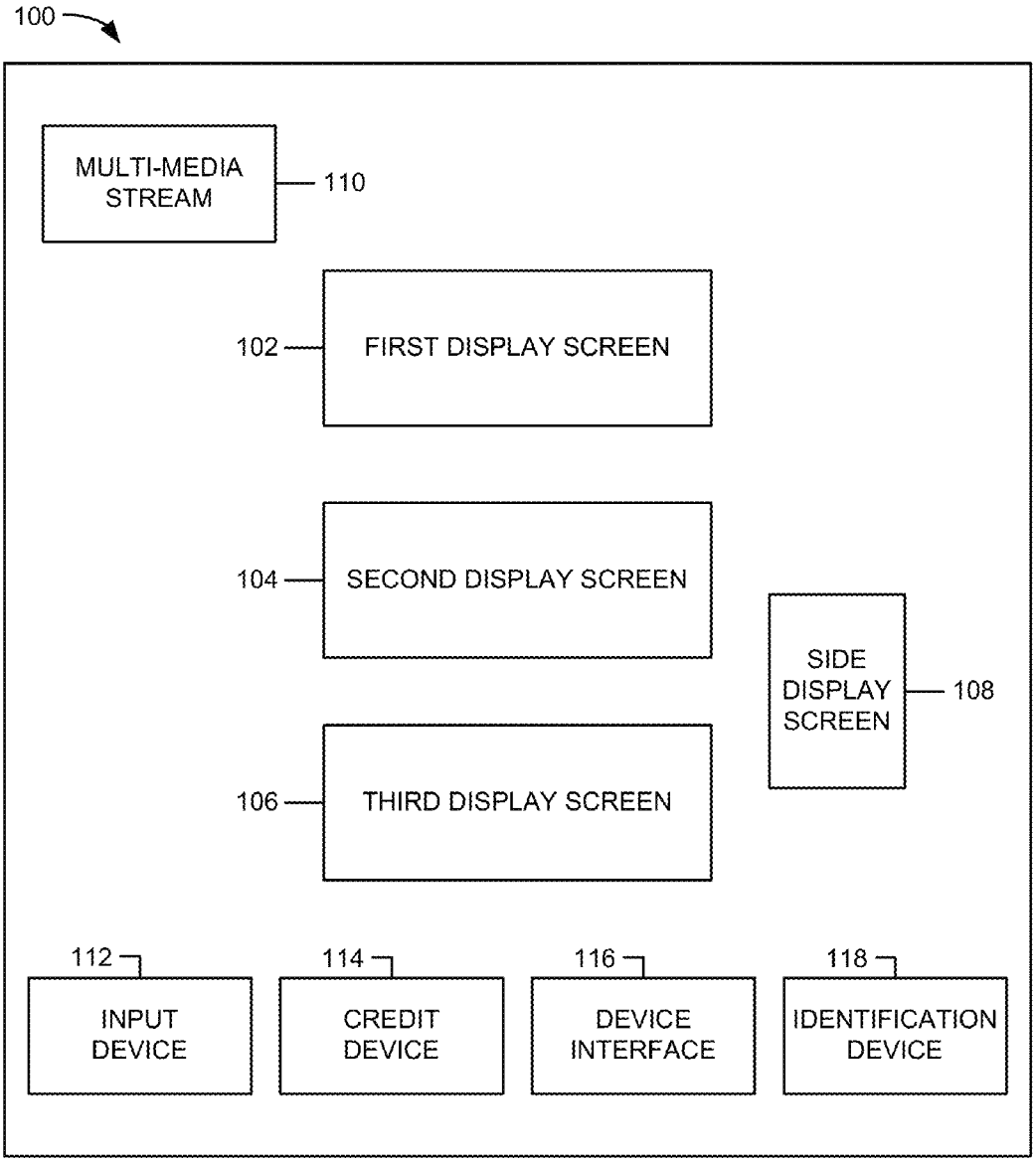
FIG. 1 is an illustration of the electronic gaming device, according to one embodiment.

FIG. 1 is an illustration of an electronic gaming device 100. Electronic gaming device 100 may include a multi-media stream 110, a first display screen 102, a second display screen 104, a third display screen 106, a side display screen 108, an input device 112, a credit device 114, a device interface 116, and an identification device 118. Electronic gaming device 100 may display one, two, a few, or a plurality of multi-media streams 110, which may be obtained from one or more gaming tables, one or more electronic gaming devices, a central server, a video server, a music server, an advertising server, another data source, and/or any combination thereof.

Multi-media streams may be obtained for an entertainment event, a wagering event, a promotional event, a promotional offering, an advertisement, a sporting event, any other event, and/or any combination thereof. For example, the entertainment event may be a concert, a show, a television program, a movie, an Internet event, and/or any combination thereof. In another example, the wagering event may be a poker tournament, a horse race, a car race, and/or any combination thereof. The advertisement may be an advertisement for a casino, a restaurant, a shop, any other entity, and/or any combination thereof. The sporting event may be a football game, a baseball game, a hockey game, a basketball game, any other sporting event, and/or any combination thereof. These multi-media streams may be utilized in combination with the gaming table video streams.

Input device 112 may be mechanical buttons, electronic buttons, mechanical switches, electronic switches, optical switches, a slot pull handle, a keyboard, a keypad, a touch screen, a gesture screen, a joystick, a pointing device (e.g., a mouse), a virtual (on-screen) keyboard, a virtual (on-screen) keypad, biometric sensor, or any combination thereof. Input device 112 may be utilized to make a wager, to select one or more repeat payline gaming options, to select one or more pattern gaming options, to obtain data relating to historical payouts, to select a row and/or column to move, to select a row area to move, to select a column area to move, to select a symbol to move, to select a game rearranging optimization option, to modify electronic gaming device 100 (e.g., change sound level, configuration, font, language, etc.), to select a movie or song, to select live multi-media streams, to request services (e.g., drinks, slot attendant, manager, etc.), to select two-dimensional ("2D") game play, to select three-dimensional ("3D") game play, to select both two-dimensional and three-dimensional game play, to change the orientation of games in a three-dimensional space, to move a symbol (e.g., wild, multiplier, etc.), or any combination thereof. These selections may occur via any other input device (e.g., a touch screen, voice commands, etc.).

Credit device 114 may be utilized to collect monies and distribute monies (e.g., cash, vouchers, etc.). Credit device 114 may interface with a mobile device to electronically transmit money and/or credits. Credit device 114 may interface with a player's card to exchange player points.

Device interface 116 may be utilized to interface electronic gaming device 100 to a bonus game device, a local area progressive controller, a wide area progressive controller, a progressive sign controller, a peripheral display device, signage, a promotional device, network components, a local network, a wide area network, remote access equipment, a slot monitoring system, a slot player tracking system, the Internet, a server, and/or any combination thereof.

Device interface 116 may be utilized to connect a player to electronic gaming device 100 through a mobile device, card, keypad, identification device 118, and/or any combination thereof. Device interface 116 may include a docking station by which a mobile device is plugged into electronic gaming machine 100. Device interface 116 may include an over the air connection by which a mobile device is connected to electronic gaming machine 100 (e.g., Bluetooth, Near Field technology, and/or Wi-Fi technology). Device interface 116 may include a connection to identification device 118.

Identification device 118 may be utilized to determine an identity of a player. Based on information obtained by identification device 118, electronic gaming device 100 may be reconfigured. For example, the language, sound level, music, placement of multi-media streams, a repeat payline gaming option may be presented, a pattern gaming option may be presented, historical gaming data may be presented, a row rearrangement option may be presented, a column rearrangement option may be presented, a row area rearrangement option may be presented, a column area rearrangement option may be presented, a two-dimensional gaming option may be presented, a three-dimensional gaming option may be presented, and/or the placement of gaming options may be modified based on player preference data. For example, a player may want to have repeat payline gaming options only. Therefore, no non-repeat payline gaming options would be presented. In another example, the player may only want to play games that include pattern gaming options only. Therefore, only games which include pattern gaming options would be presented to the player. In another example, the player may only want to play games that include historical information relating to game play. Therefore, only games which include historical gaming data would be presented to the player.

Identification device 118 may utilize biometrics (e.g., thumb print, retinal scan, or other biometric). Identification device 118 may include a card entry slot into input device 112. Identification device 118 may include a keypad with an assigned pin number for verification. Identification device 118 may include multiple layers of identification for added security. For example, a player could be required to enter a player tracking card, and/or a pin number, and/or a thumb print, and/or any combination thereof. Based on information obtained by identification device 118, electronic gaming device 100 may be reconfigured. For example, the language, sound level, music, placement of video streams, placement of images, and the placement of gaming options utilized may be modified based on a player's preference data. For example, a player may have selected baseball under the sporting event preferences; electronic gaming device 100 will then automatically display the current baseball game onto side display screen 108 and/or an alternate display screen as set in the player's options.

First display screen 102 may be a liquid crystal display ("LCD"), a cathode ray tube display ("CRT"), organic light-emitting diode display ("OLED"), plasma display panel ("PDP"), electroluminescent display ("ELD"), a light-emitting diode display ("LED"), or any other display technology. First display screen 102 may be used for displaying primary games or secondary (bonus) games, advertising, player attractions, electronic gaming device 100 configuration parameters and settings, game history, accounting meters, events, alarms, and/or any combination thereof. Second display screen 104, third display screen 106, side display screen 108, and any other screens may utilize the same technology as first display screen 102 and/or any combination of technologies.

First display screen 102 may also be virtually combined with second display screen 104. Likewise second display screen 104 may also be virtually combined with third display screen 106. First display screen 102 may be virtually combined with both second display screen 104 and third display screen 106. Any combination thereof may be formed.

For example, a single large image could be partially displayed on second display screen 104 and partially displayed on third display screen 106, so that when both display screens are put together they complete one image. Electronic gaming device 100 may stream or play prerecorded multi-media data, which may be displayed on any display combination.

Figure 2:
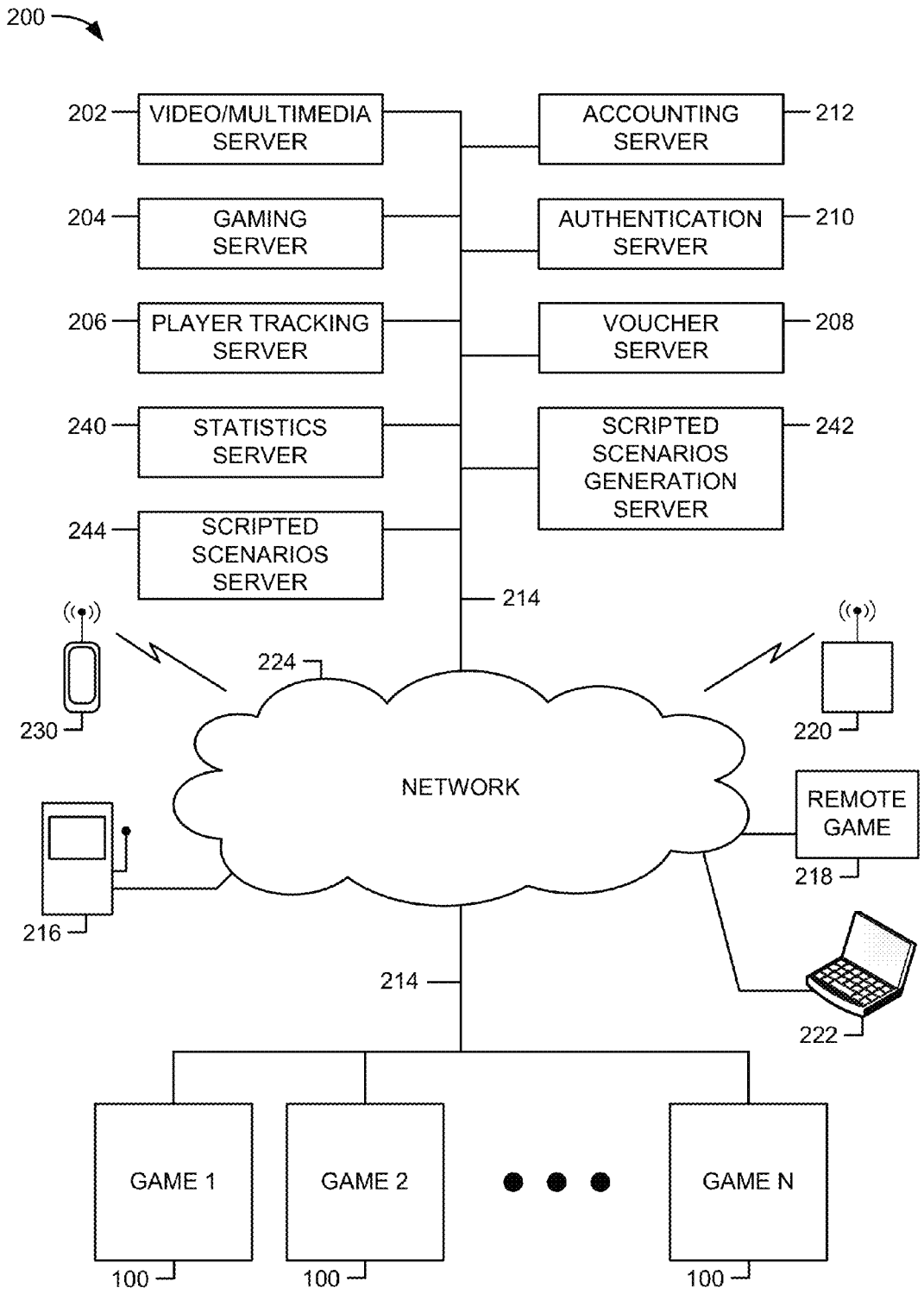
FIG. 2 is an illustration of an electronic gaming system, according to one embodiment.

In FIG. 2, an electronic gaming system 200 is shown. Electronic gaming system 200 may include a video/multimedia server 202, a gaming server 204, a player tracking server 206, a voucher server 208, an authentication server 210, an accounting server 212, a statistics server 240, a scripted scenarios generation server 242, and a scripted scenarios server 244.

Electronic gaming system 200 may include video/multimedia server 202, which may be coupled to network 224 via a network link 214. Network 224 may be the Internet, a private network, and/or a network cloud. One or more video streams may be received at video/multimedia server 202 from other electronic gaming devices 100. Video/multimedia server 202 may transmit one or more of these video streams to a mobile phone 230, electronic gaming device 100, a remote electronic gaming device at a different location in the same property 216, a remote electronic gaming device at a different location 218, a laptop 222, and/or any other remote electronic device 220. Video/multimedia server 202 may transmit these video streams via network link 214 and/or network 224.

For example, a remote gaming device at the same location may be utilized at a casino with multiple casino floors, a casino that allows wagering activities to take place from the hotel room, a casino that may allow wagering activities to take place from the pool area, etc. In another example, the remote devices may be at another location via a progressive link to another casino, and/or a link within a casino corporation that owns numerous casinos (e.g., MGM, Caesars, etc.).

Gaming server 204 may generate gaming outcomes. Gaming server 204 may provide electronic gaming device 100 with game play content. Gaming server 204 may provide electronic gaming device 100 with game play math and/or outcomes.

Player tracking server 206 may track a player's betting activity, a player's preferences (e.g., language, font, sound level, drinks, etc.). Based on data obtained by player tracking server 206, a player may be eligible for gaming rewards (e.g., free play), promotions, and/or other awards (e.g., complimentary food, drinks, lodging, concerts, etc.).

Voucher server 208 may generate a voucher, which may include data relating to gaming. Further, the voucher may include payline structure option selections. In addition, the voucher may include repeat payline data, pattern data, historical payout data, columns, rows, and/or symbols that were modified.

Authentication server 210 may determine the validity of vouchers, player's identity, and/or an outcome for a gaming event.

Accounting server 212 may compile, track, and/or monitor cash flows, voucher transactions, winning vouchers, losing vouchers, and/or other transaction data. Transaction data may include the number of wagers, the size of these wagers, the date and time for these wagers, the identity of the players making these wagers, and/or the frequency of the wagers. Accounting server 212 may generate tax information relating to these wagers. Accounting server 212 may generate profit/loss reports for players' tracked outcomes.

Network connection 214 may be used for communication between dedicated servers, thin clients, thick clients, back-office accounting systems, etc.

Laptop computer 222 and/or any other electronic devices (e.g., mobile phone 230, electronic gaming device 100, etc.) may be used for downloading new gaming device applications or gaming device related firmware through remote access.

Laptop computer 222 and/or any other electronic device (e.g., mobile phone 230, electronic gaming device 100, etc.) may be used for uploading accounting information (e.g., cashable credits, non-cashable credits, coin in, coin out, bill in, voucher in, voucher out, etc.).

Network 224 may be a local area network, a casino premises network, a wide area network, a virtual private network, an enterprise private network, the Internet, or any combination thereof. Hardware components, such as network interface cards, repeaters and hubs, bridges, switches, routers, firewalls, or any combination thereof may also be part of network 224.

Statistics server 240 may be used to maintain data relating to historical game play for one or more electronic gaming devices 100. This historical data may include winning amounts, winning data (e.g., person, sex, age, time on machine, amount of spins before winning event occurred, etc.), fastest winning event reoccurrence, longest winning event reoccurrence, average frequencies of winning events, average winning amounts, highest winning amount, lowest winning amount, locations for winning events, winning event dates, winning machines, winning game themes, and/or any other data relating to game play.

Statistics server 240 may include data relating to one or more scripted scenarios. This data may include the number of advertising scripted scenarios presented. For example, a first advertising scripted scenario may have been presented 100 times, which has a charge back (e.g., cost) to the advertiser of $100. A second advertising scripted scenario may have been presented 10,000 times, which has a charge back of $1,000. Statistics server 240 may also include data relating to the utilization of scripts, scripted scenarios, expandable scripted scenarios, dynamic scripted scenarios, and/or any other script.

Scripted scenarios generation server 242 may generate one or more scripted scenarios including one or more scripted scenarios, one or more scripts, one or more dynamic scripted scenarios, one or more expandable scripted scenarios, and/or one or more favorite scripted scenarios.

Scripted scenarios server 244 may store and display one or more scripted scenarios including one or more scripted scenarios, one or more scripts, one or more dynamic scripted scenarios, one or more expandable scripted scenarios, and/or one or more favorite scripted scenarios.

Figure 3:
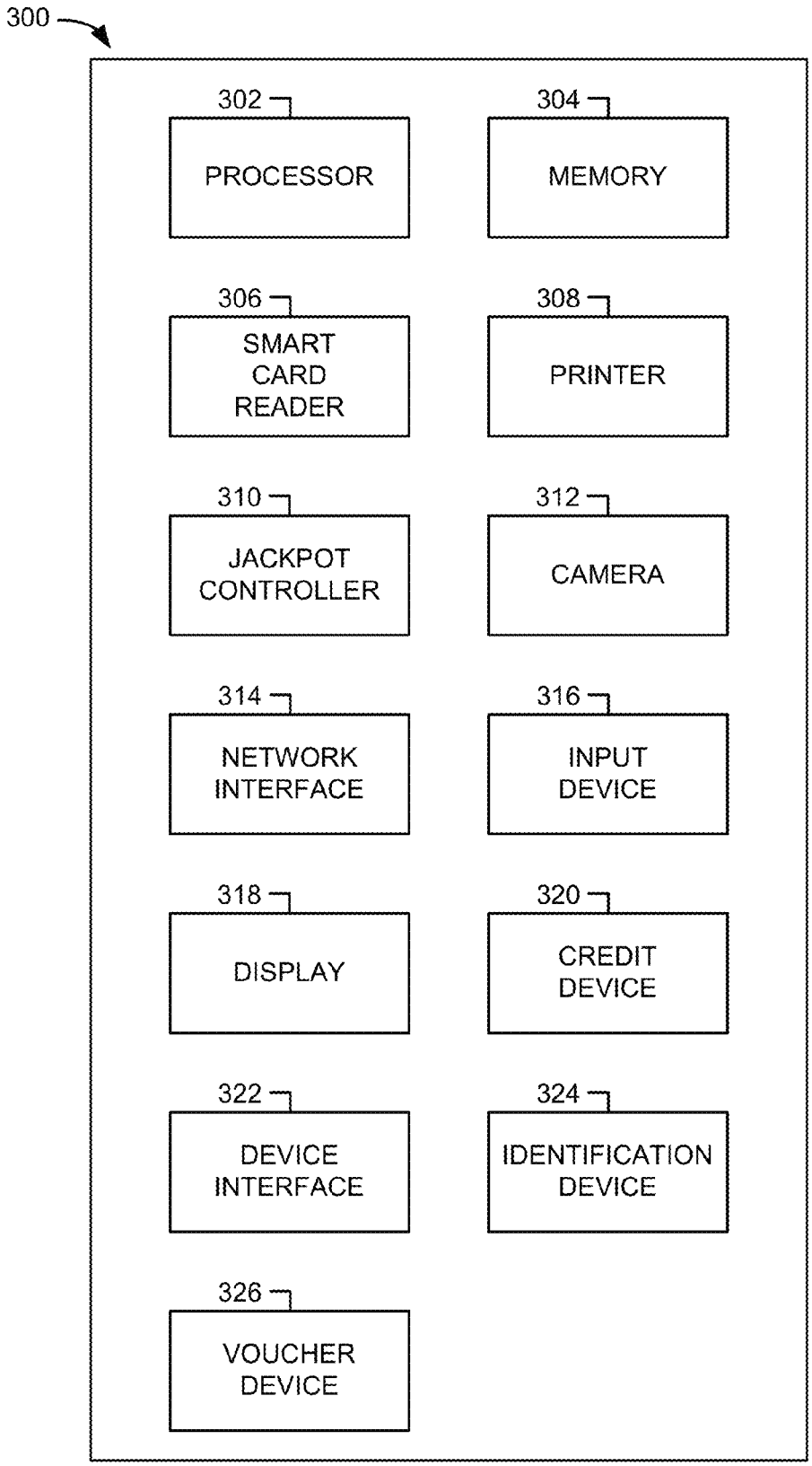
FIG. 3 is a block diagram of the electronic gaming device, according to one embodiment.

FIG. 3 shows a block diagram 300 of electronic gaming device 100. Electronic gaming device 100 may include a processor 302, a memory 304, a smart card reader 306, a printer 308, a jackpot controller 310, a camera 312, a network interface 314, an input device 316, a display 318, a credit device 320, a device interface 322, an identification device 324, and a voucher device 326.

Processor 302 may execute program instructions of memory 304 and use memory 304 for data storage. Processor 302 may also include a numeric co-processor, or a graphics processing unit (or units) for accelerated video encoding and decoding, and/or any combination thereof.

Processor 302 may include communication interfaces for communicating with electronic gaming device 100, electronic gaming system 200, and user interfaces to enable communication with all gaming elements. For example, processor 302 may interface with memory 304 to access a player's mobile device through device interface 322 to display contents onto display 318. Processor 302 may generate a voucher based on a wager confirmation, which may be received by an input device, a server, a mobile device, and/or any combination thereof. A voucher device may generate, print, transmit, or receive a voucher. Memory 304 may include communication interfaces for communicating with electronic gaming device 100, electronic gaming system 200, and user interfaces to enable communication with all gaming elements. For example, the information stored on memory 304 may be printed out onto a voucher by printer 308. Videos or pictures captured by camera 312 may be saved and stored on memory 304. Memory 304 may include a confirmation module, which may authenticate a value of a voucher and/or the validity of the voucher. Processor 302 may determine the value of the voucher based on generated voucher data and data in the confirmation module. Electronic gaming device 100 may include a player preference input device. The player preference input device may modify a game configuration. The modification may be based on data from the identification device.

Memory 304 may be non-volatile semiconductor memory, such as read-only memory ("ROM"), erasable programmable read-only memory ("EPROM"), electrically erasable programmable read-only memory ("EEPROM"), flash memory ("NVRAM"), Nano-RAM (e.g., carbon nanotube random access memory), and/or any combination thereof.

Memory 304 may also be volatile semiconductor memory such as, dynamic random access memory ("DRAM"), static random access memory ("SRAM"), and/or any combination thereof.

Memory 304 may also be a data storage device, such as a hard disk drive, an optical disk drive such as, CD, DVD, Blu-ray, a solid state drive, a memory stick, a CompactFlash card, a USB flash drive, a Multi-media Card, an xD-Picture Card, and/or any combination thereof.

Memory 304 may be used to store read-only program instructions for execution by processor 302, for the read-write storage for global variables and static variables, read-write storage for uninitialized data, read-write storage for dynamically allocated memory, for the read-write storage of the data structure known as "the stack," and/or any combination thereof.

Memory 304 may be used to store the read-only paytable information for which symbol combinations on a given payline that result in a win (e.g., payout) which are established for games of chance, such as slot games and video poker.

Memory 304 may be used to store accounting information (e.g., cashable electronic promotion in, non-cashable electronic promotion out, coin in, coin out, bill in, voucher in, voucher out, electronic funds transfer in, etc.).

Memory 304 may be used to record error conditions on an electronic gaming device 100, such as door open, coin jam, ticket print failure, ticket (e.g., paper) jam, program error, reel tilt, etc., and/or any combination thereof.

Memory 304 may also be used to record the complete history for the most recent game played, plus some number of prior games as may be determined by the regulating authority.

Smart card reader 306 may allow electronic gaming device 100 to access and read information provided by the player or technician, which may be used for setting the player preferences and/or providing maintenance information. For example, smart card reader 306 may provide an interface between a smart card (inserted by the player) and identification device 324 to verify the identity of a player.

Printer 308 may be used for printing slot machine payout receipts, slot machine wagering vouchers, non-gaming coupons, slot machine coupons (e.g., a wagering instrument with a fixed waging value that can only be used for non-cashable credits), drink tokens, comps, and/or any combination thereof.

Electronic gaming device 100 may include a jackpot controller 310, which may allow electronic gaming device 100 to interface with other electronic gaming devices either directly or through electronic gaming system 200 to accumulate a shared jackpot.

Camera 312 may allow electronic gaming device 100 to take images of a player or a player's surroundings. For example, when a player sits down at the machine their picture may be taken to include his or her image into the game play. A picture of a player may be an actual image as taken by camera 312. A picture of a player may be a computerized caricature of the image taken by camera 312. The image obtained by camera 312 may be used in connection with identification device 324 using facial recognition. Camera 312 may allow electronic gaming device 100 to record video. The video may be stored on memory 304 or stored remotely via electronic gaming system 200. Videos obtained by camera 312 may then be used as part of game play, or may be used for security purposes. For example, a camera located on electronic gaming device 100 may capture videos of a potential illegal activity (e.g., tampering with the machine, crime in the vicinity, underage players, etc.).

Network interface 314 may allow electronic gaming device 100 to communicate with video/multimedia server 202, gaming server 204, player tracking server 206, voucher server 208, authentication server 210, accounting server 212, statistics server 240, scripted scenarios generation server 242, and/or scripted scenarios server 244.

Input device 316 may be mechanical buttons, electronic buttons, a touch screen, and/or any combination thereof. Input device 316 may be utilized to make a wager, to make an offer to buy or sell a voucher, to determine a vouchers worth, to cash in a voucher, to modify electronic gaming device 100 (e.g., change sound level, configuration, font, language, etc.), to select a movie or music, to select live video streams (e.g., sporting event 1, sporting event 2, sporting event 3), to request services (e.g., drinks, manager, etc.), and/or any combination thereof.

Display 318 may show video streams from one or more content sources. Display 318 may encompass first display screen 102, second display screen 104, third display screen 106, side display screen 108, and/or another screen used for displaying video content.

Credit device 320 may be utilized to collect monies and distribute monies (e.g., cash, vouchers, etc.). Credit device 320 may interface with processor 302 to allow game play to take place. Processor 302 may determine any payouts, display configurations, animation, and/or any other functions associated with game play. Credit device 320 may interface with display 318 to display the amount of available credits for the player to use for wagering purposes. Credit device 320 may interface via device interface 322 with a mobile device to electronically transmit money and/or credits. Credit device 320 may interface with a player's pre-established account, which may be stored on electronic gaming system 200, to electronically transmit money and/or credit. For example, a player may have a credit card or other mag-stripe card on file with the location for which money and/or credits can be directly applied when the player is done. Credit device 320 may interface with a player's card to exchange player points.

Electronic gaming device 100 may include a device interface 322 that a user may employ with his or her mobile device (e.g., smart phone) to receive information from and/or transmit information to electronic gaming device 100 (e.g., watch a movie, listen to music, obtain verbal betting options, verify identification, transmit credits, etc.).

Identification device 324 may be utilized to allow electronic gaming device 100 to determine an identity of a player. Based on information obtained by identification device 324, electronic gaming device 100 may be reconfigured. For example, the language, sound level, music, placement of video streams, placement of images, placement of gaming options, and/or the tables utilized may be modified based on player preference data.

For example, a player may have selected a specific baseball team (e.g., Atlanta Braves) under the sporting event preferences, the electronic gaming device 100 will then automatically (or via player input) display the current baseball game (e.g., Atlanta Braves vs. Philadelphia Phillies) onto side display screen 108 and/or an alternate display screen as set in the player's options.

A voucher device 326 may generate, print, transmit, or receive a voucher. The voucher may represent a wagering option, a wagering structure, a wagering timeline, a value of wager, a payout potential, a payout, and/or any other wagering data. A voucher may represent an award, which may be used at other locations inside of the gaming establishment. For example, the voucher may be a coupon for the local buffet or a concert ticket.

Figure 4:
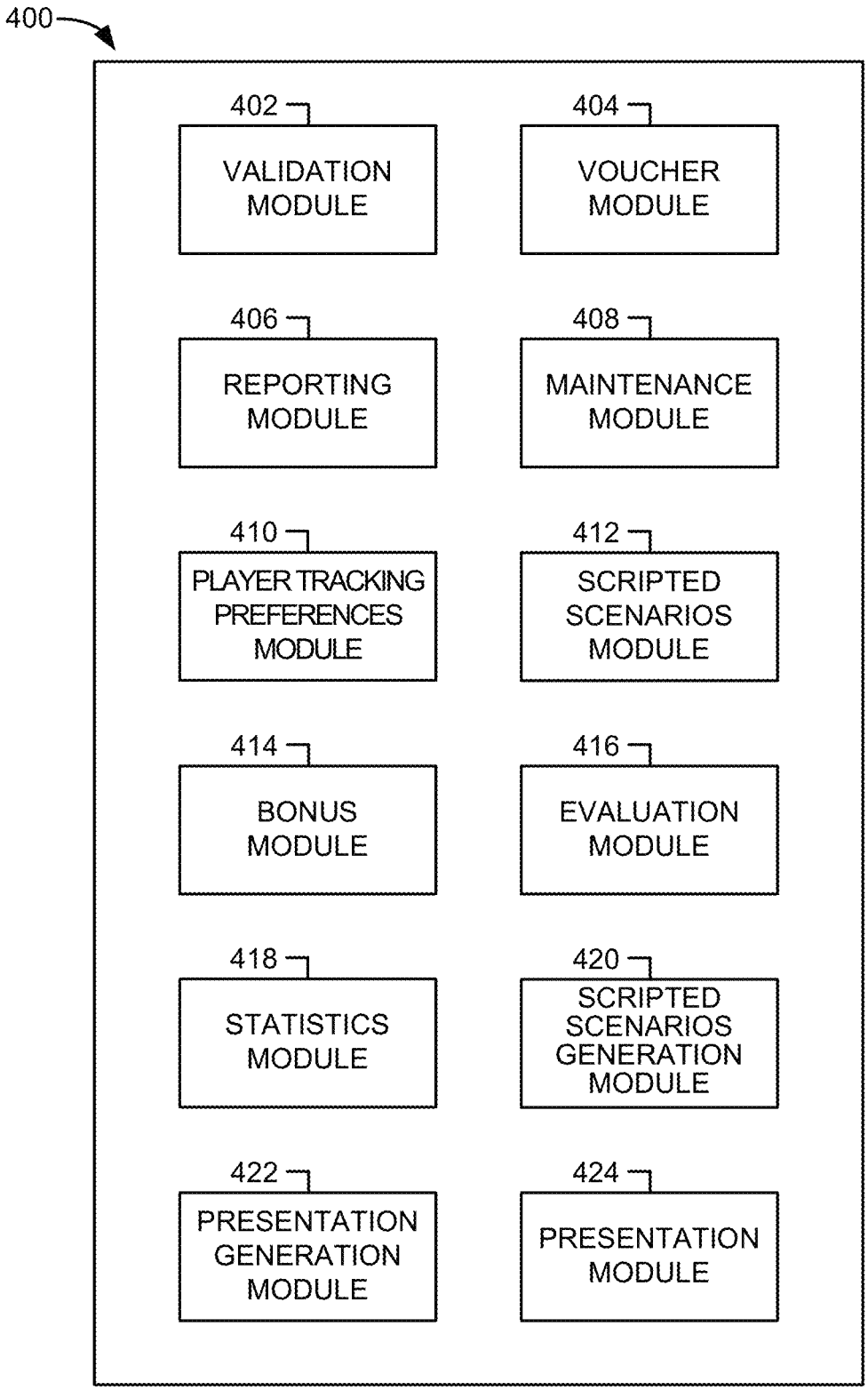
FIG. 4 is another block diagram of the electronic gaming device, according to one embodiment.

FIG. 4 shows a block diagram of memory 304, which includes various modules. Memory 304 may include a validation module 402, a voucher module 404, a reporting module 406, a maintenance module 408, a player tracking preferences module 410, a scripted scenarios module 412, a bonus module 414, an evaluation module 416, a statistics module 418, a scripted scenarios generation module 420, a presentation generation module 422, and a presentation module 424.

Validation module 402 may utilize data received from voucher device 326 to confirm the validity of the voucher.

Voucher module 404 may store data relating to generated vouchers, redeemed vouchers, bought vouchers, and/or sold vouchers.

Reporting module 406 may generate reports related to a performance of electronic gaming device 100, electronic gaming system 200, video streams, gaming objects, credit device 114, and/or identification device 118.

Maintenance module 408 may track any maintenance that is implemented on electronic gaming device 100 and/or electronic gaming system 200. Maintenance module 408 may schedule preventative maintenance and/or request a service call based on a device error.

Player tracking preferences module 410 may compile and track data associated with a player's preferences.

Scripted scenarios module 412 may store one or more scripted scenarios including one or more scripted scenarios, one or more scripts, one or more dynamic scripted scenarios, one or more expandable scripted scenarios, and/or one or more favorite scripted scenarios.

Bonus module 414 may generate a bonus game, evaluate the results of the bonus game, trigger bonus game presentations, generate bonus game payouts, and display any data relating to the bonus game.

Evaluation module 416 may determine payouts related to game results.

Statistics module 418 may include data relating to one or more scripted scenarios. This data may include the number of advertising scripted scenarios presented. For example, a first advertising scripted scenario may have been presented 100 times, which has a charge back (e.g., cost) to the advertiser of $100. A second advertising scripted scenario may have been presented 10,000 times, which has a charge back of $1,000. Statistics module 418 may also include data relating to the utilization of scripts, scripted scenarios, expandable scripted scenarios, dynamic scripted scenarios, and/or any other script.

Scripted scenarios generation module 420 may generate one or more scripted scenarios including one or more scripted scenarios, one or more scripts, one or more dynamic scripted scenarios, one or more expandable scripted scenarios, and/or one or more favorite scripted scenarios.

Presentation generation module 422 may generate the presentation data (e.g., visual and audio) relating to one or more scripted scenarios including one or more scripted scenarios, one or more scripts, one or more dynamic scripted scenarios, one or more expandable scripted scenarios, and/or one or more favorite scripted scenarios.

Presentation module 424 may display one or more scripted scenarios including one or more scripted scenarios, one or more scripts, one or more dynamic scripted scenarios, one or more expandable scripted scenarios, and/or one or more favorite scripted scenarios.

It should be noted that one or more modules may be combined into one module. Further, there may be one evaluation module where the determined payout does not depend on whether there were any wild symbols, scatter symbols, and/or any other specific symbols. Further, any module, device, and/or logic function in electronic gaming device 100 may be present in electronic gaming system 200. In addition, any module, device, and/or logic function in electronic gaming system 200 may be present in electronic gaming device 100.

Figure 5:
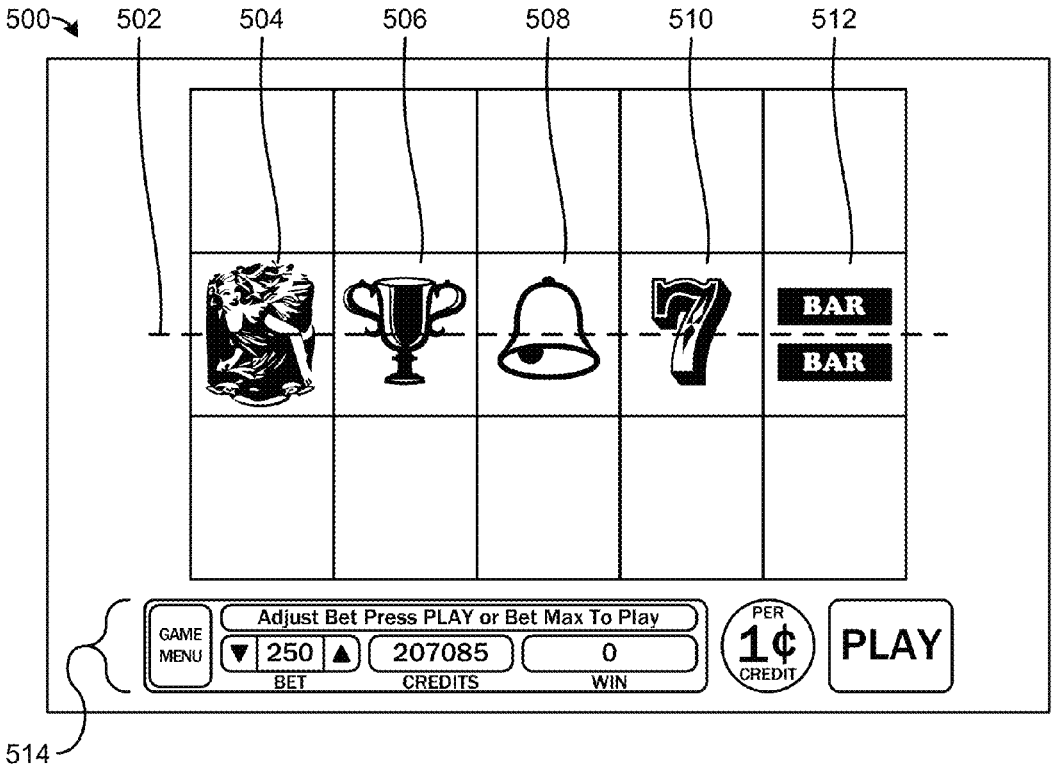
FIG. 5 is an illustration of a matrix including a plurality of reels, according to one embodiment.

FIG. 5 shows a screen image 500 for electronic gaming device 100 on display 318. Screen image 500 may include a predetermined number of columns and a predetermined number of rows. Screen image 500 may include any number of rows and any number of columns. For example, screen image 500 may have five rows and ten columns; screen image 500 may have eight rows and thirteen columns, or any other combinations of rows and columns. The player may initiate a wagering event through input device 316. Images in each cell may scroll up and/or down and/or side-to-side. Positioning of the images displayed in the reels on screen image 500 may display the outcome of a wagering event (e.g., a win or a loss for the player).

For example, it may be that if all columns in a first row have the same image (e.g., cherries, bars, pictures of the player as captured by camera 312, etc.) then a winning event has occurred. Lining up of the images may happen in one of many ways. For example, if all images in the various cells, which are touching by a shared side or by a corner, have the same image this may represent that a winning event has occurred.

Screen image 500 may include a first payline 502, a first image 504, a second image 506, a third image 508, a fourth image 510, a fifth image 512, and a game data area 514. First image 504, second image 506, third image 508, fourth image 510, and fifth image 512 may be an image (e.g., card, letter, bar, cherry, blank, etc.). Game data area 514 may include additional data relating to the games. For example, a game menu, a bet amount, a winning total, a credit total, a betting increment (e.g., $0.01 per credit), an input button (e.g., play, deal, draw, etc.), and/or any other gaming data may be shown.

Game menu button may include data relating to the game. For example, the payout structures, payout odds, the amount won over a predetermined number of game plays, the amount won over a specific time frame, and/or any other game play data may be accessed via game menu button. Game menu button may be utilized to change the game from a first game (e.g., slot machine theme 1) to a second game (e.g., slot machine theme 2, poker, blackjack, roulette, baccarat, craps, etc.). Game menu button may be utilized to change any other game structure (e.g., credit amounts). For example, the credit amount may be increased/decreased between $0.01 to $1.00 and/or any other values.

Bet reducer button (e.g., the downward arrow) may decrease the amount of credits wagered on game play. Bet amount image (e.g., 250) may show the amount of credits wagered on game play. Bet increaser button (e.g., the upward arrow) may increase the amount of credits wagered on game play. Credit amount image (e.g., 207085) may show the amount of credits available to the player for game play. Win amount area (e.g., 0) may show the payout amount of the last event. Credit value image (e.g., $0.01) may show the value of a single credit. Play button may start the next game. Message area may display any message to the player. In this case, the message states "Adjust Bet Press PLAY or Bet Max to Play".

Figure 6A:
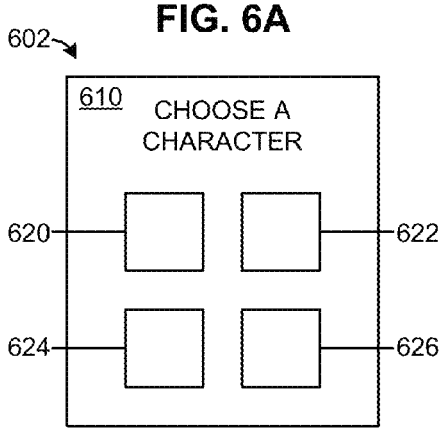
FIG. 6A is a block diagram for a character selection option, according to one embodiment.

FIG. 6A is a block diagram for a first character selection option 602, according to one embodiment. First character selection option 602 may include a selection area 610, a first character 620, a second character 622, a third character 624, and a fourth character 626. In one example, the player may select one character from the four characters available for selection. Any number of characters and any number of selections may be utilized.

Figure 6B:
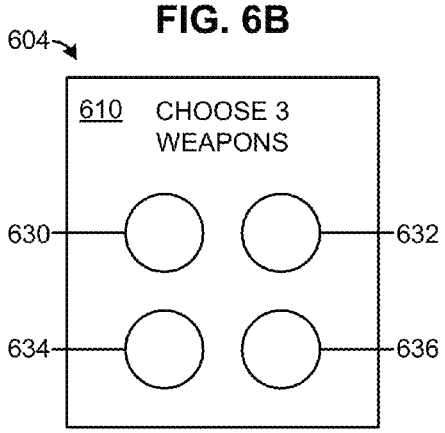
FIG. 6B is a block diagram for a weapon selection option, according to one embodiment.

FIG. 6B is a block diagram for a first weapon selection option 604, according to one embodiment. First weapon selection option 604 may include selection area 610, a first weapon 630, a second weapon 632, a third weapon 634, and a fourth weapon 636. In one example, the player may select three weapons from the four weapons available for selection. Any number of weapons and any number of selections may be utilized.

Figure 6C:
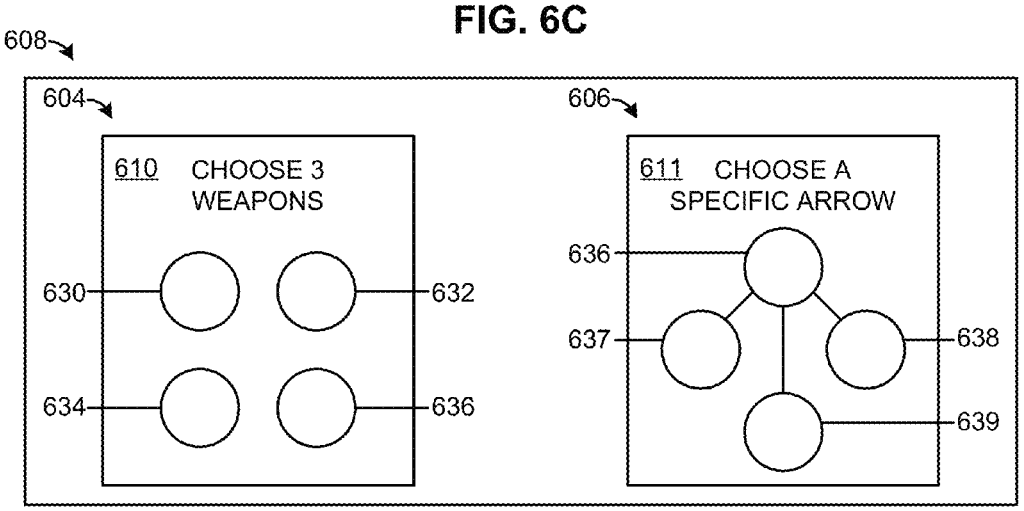
FIG. 6C is another block diagram for a weapon selection option, according to one embodiment.

FIG. 6C is another block diagram for a multi-level weapon selection option 608, according to one embodiment. Multi-level weapon selection option 608 may include selection area 610, a second selection area 611, first weapon 630, second weapon 632, third weapon 634, fourth weapon 636, a first multi-level weapon selection option 637, a second multi-level weapon selection option 638, and a third multi-level weapon selection option 639. In one example, if the player selects fourth weapon 636, then the player may have the option to select one or more of first multi-level weapon selection option 637, second multi-level weapon selection option 638, and third multi-level weapon selection option 639.

Any number of multi-level items may be utilized, along with any number of selections.

Figure 6D:
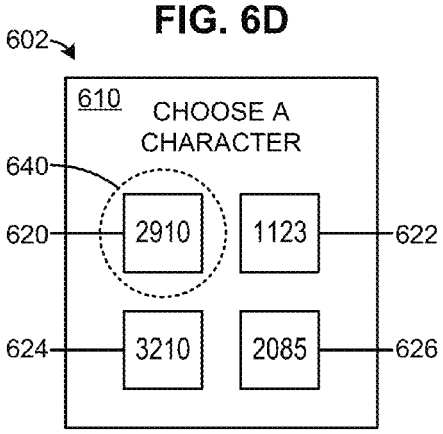
FIG. 6D is a block diagram for a character selection option, according to one embodiment.

FIG. 6D is another block diagram for first character selection option 602, according to one embodiment. First character selection option 602 may include selection area 610, first character 620, second character 622, third character 624, fourth character 626, and a first character selection 640. In one example, the player may select one character from the four characters available for selection. If the player selects first character 620 via first character selection 640, then the award amount may be 2,910 credits for this selection. If the player had selected second character 622, then the award amount may have been 1,123 credits for this selection. If the player had selected third character 624, then the award amount may have been 3,210 credits for this selection. If the player had selected fourth character 626, then the award amount may have been 2,085 credits for this selection.

Figure 6E:
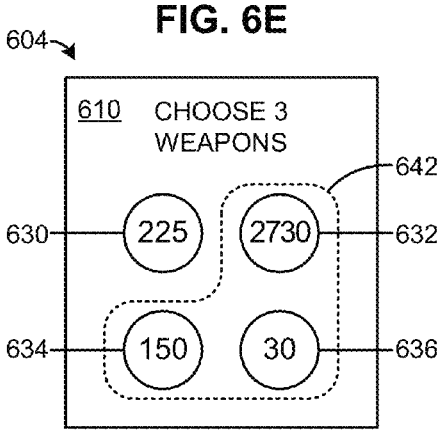
FIG. 6E is a block diagram for a weapon selection option, according to one embodiment.

FIG. 6E is a block diagram for first weapon selection option 604, according to one embodiment. First weapon selection option 604 may include selection area 610, first weapon 630, second weapon 632, third weapon 634, fourth weapon 636, and a weapons selection 642. In one example, the player may select three weapons from the four weapons available for selection. If the player makes weapons selection 642, which included second weapon 632, third weapon 634, and fourth weapon 636, then the award amount for this selection may have been 2,910 credits (e.g., 2,730+150+30=2,910). If the player makes a selection of first weapon 630, third weapon 634, and fourth weapon 636, then the award amount may have been 405 credits (e.g., 225+150+30=405).

Figure 6F:
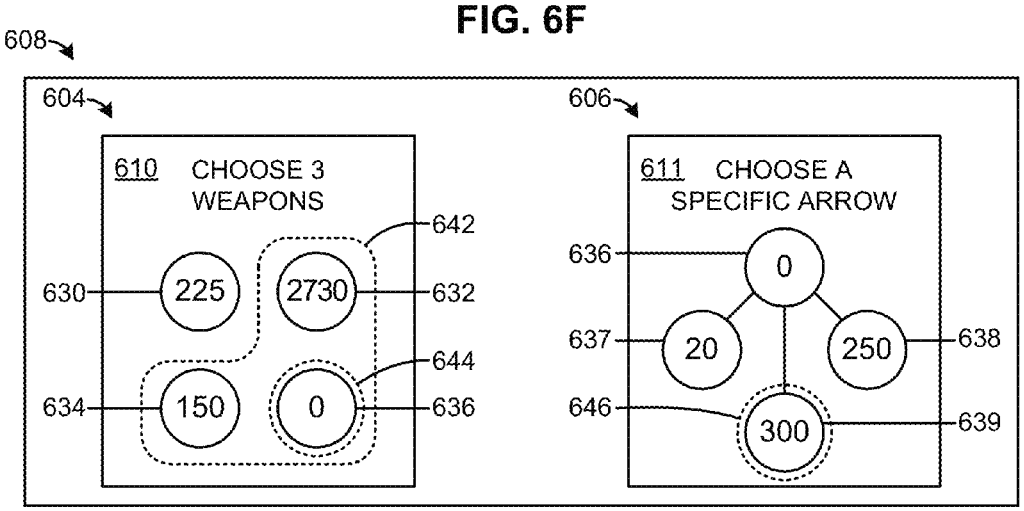
FIG. 6F is another block diagram for a weapon selection option, according to one embodiment.

FIG. 6F is another block diagram for a multi-level weapon selection option 608, according to one embodiment. Multi-level weapon selection option 608 may include selection area 610, second selection area 611, first weapon 630, second weapon 632, third weapon 634, fourth weapon 636, first multi-level weapon selection option 637, second multi-level weapon selection option 638, third multi-level weapon selection option 639, weapons selection 642, a weapon with multi-level options 644, and a multi-level weapon selection 646. In one example, if the player selects fourth weapon 636, then the player may have the option to select one or more of first multi-level weapon selection option 637, second multi-level weapon selection option 638, and third multi-level weapon selection option 639. If the player selects via multi-level weapon selection 646 third multi-level weapon selection option 639, then the award amount increases to 3,180 credits (e.g., 2,730+150+300=3,180) as compared to the non-multi-level weapon selection option (e.g., 2,910). If the player selects second multi-level weapon selection option 638, then the award amount increases to 3,130 credits (e.g., 2,730+150+250=3,130) as compared to the non-multi-level weapon selection option (e.g., 2,910). If the player selects first multi-level weapon selection option 637, then the award amount decreases to 2,900 credits (e.g., 2,730+150+20=2,910) as compared to the non-multi-level weapon selection option (e.g., 2,910).

The key value may be any combination of awards (e.g., credits, free spins, multipliers, etc.). Further, the awards from one or more actions may be combined. For example, a key value may be 6,090 credits, which may be obtained by adding 2,910 credits from the selection of first character 622 and 3,180 credits from the total outcome of selecting third multi-level weapon selection option 639.

Figure 7:
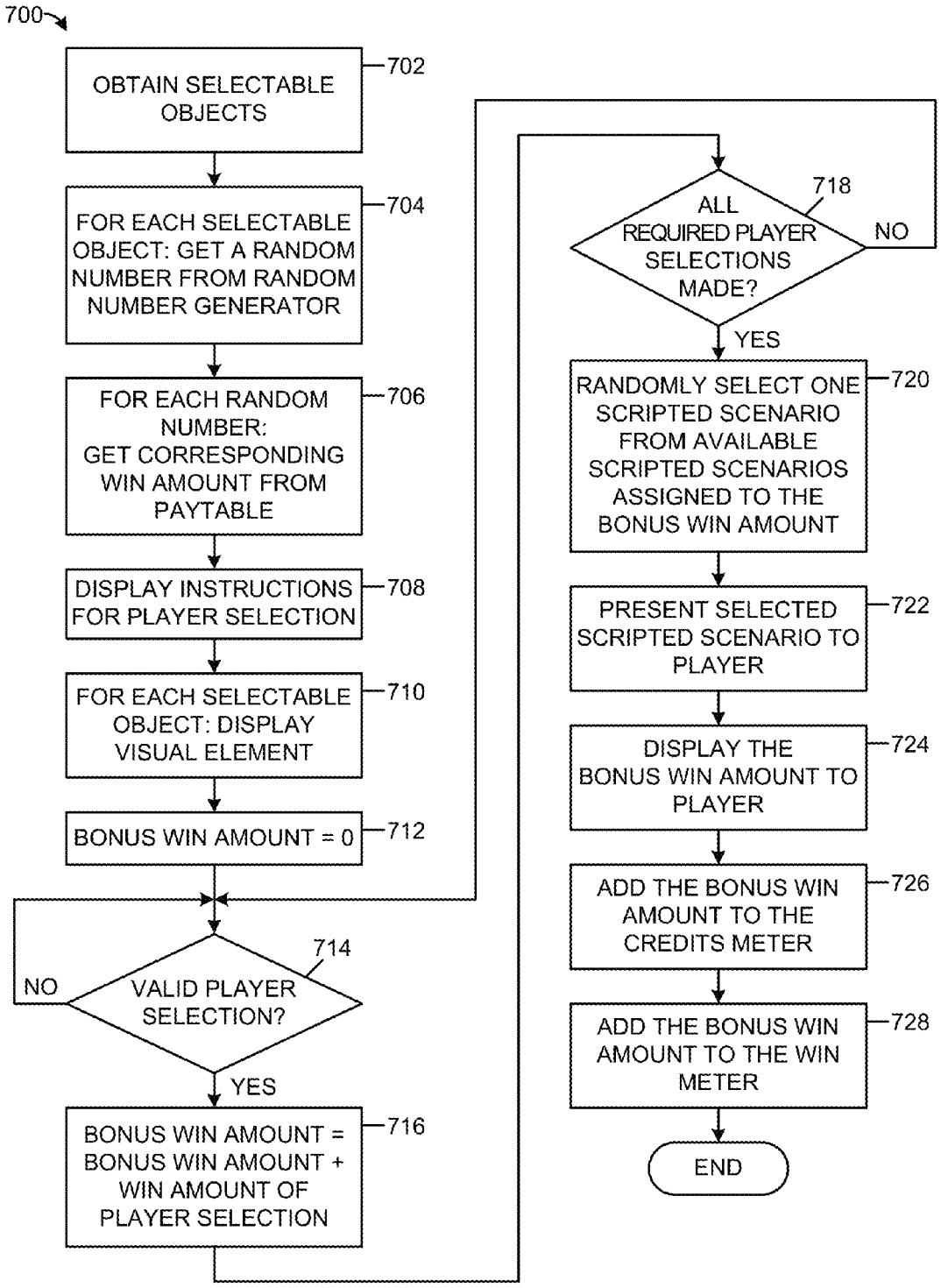
FIG. 7 is a flow diagram for a scripted scenario game play, according to one embodiment.

FIG. 7 is a flow diagram for a scripted scenario game play 700, according to one embodiment. The method may include the starting of the game. The method may include obtaining one or more selectable objects (step 702). The method may include for each selectable object generating a random number from a random number generator (step 704). The method may include for each random number obtaining a corresponding win amount from the paytable (step 706). The method may include displaying instructions for the player to selection one or more objects (step 708). The method may include for each selectable object displaying a visual element (step 710). The visual element may be related to the selectable object. The method may include setting the bonus win amount to zero (step 712). The method may include electronic gaming device 100 and/or electronic gaming system 200 determining whether a valid player selection has occurred (step 714). If no valid player selection has occurred, the method moves back to step 714. If a valid player selection has occurred, the method may determine the bonus win amount (step 716). The method may include electronic gaming device 100 and/or electronic gaming system 200 determining whether all required selections have occurred (step 718). If all of the required selections have not occurred, then the method moves back to step 714. If all of the required selections have occurred, then the method may select (e.g., randomly, by a predetermined pattern, etc.) one scripted scenario from the available scripted scenarios assigned to the bonus win amount (step 720). The method may include presenting the selected scripted scenario to the player (step 722). The method may include displaying the bonus win amount to the player (step 724). The method may include adding the bonus win amount to the credits meter (step 726). The method may include adding the bonus win amount to the win meter (step 728). The method may then end.

FIG. 8 is an illustration of scripted scenario building blocks 800, according to one embodiment. Scripted scenario building blocks 800 may include an item list 802, an element category 804, a multiplier 806, and a normalized bet category 808. In one example, index 802 may have numerous indexes (e.g., 1 to N, which may be labeled any numbers including 0 to N). For example, item list 802 may include items from 0 to 25. For illustration purposes, these items may include a third item 807, a ninth item 813, a sixteenth item 819, and a twenty-second item 825.

Each item may relate to one or more presentation elements (e.g., visual elements and audio elements), one or more multipliers (or other prize), and/or one or more normalized betting categories. For example, third item 807 may include a red weapon (e.g., fourth red weapon 809), a six times multiplier (e.g., third index multiplier 811), and no normalized betting category. In one example, fourth red weapon 809 may include visual data (e.g., size, firing direction, firing pattern, etc.) and audio data (e.g., a weapon's sound, a target hit sound, etc.).

In another example, ninth item 813 may include a blue weapon (e.g., second blue weapon 815), a three times multiplier (e.g., ninth index multiplier 817), and no normalized betting category.

In another example, sixteenth item 819 may include a red pirate (e.g., second red pirate 821), no multiplier, and a 10 normalized betting category (e.g., a second normalized betting category 823).

In another example, twenty-second item 825 may include a blue pirate (e.g., second blue pirate 827), no multiplier, and a 35 normalized betting category (e.g., an eighth normalized betting category 829).

It should be noted that any combination of item list 802, element category 804, multiplier 806, and normalized bet category 808 may be utilized.

Element category 804 may include numerous presentation items (e.g., red weapon, blue weapon, green weapon, bonus multiplier, red pirate, green pirate, blue pirate, whammy pirate, starting pirate, ending pirate, save images, etc.). Element category 804 may also include sound levels, various sound (e.g., gun fire, cannon fire, pirate sounds, ship noises, attacking sounds, injury sounds, people speaking, animal sounds, etc.). For example, element category 804 may include red weapon, blue weapon, green weapon, bonus multiplier, red pirate, green pirate, blue pirate, whammy pirate, and ending pirate. This element category 804 may include a fourth red weapon 809, a second blue weapon 815, a second red pirate 821, and a second blue pirate 827.

Multiplier 806 may include any item, which multiplies (e.g., 2× to N×) an award. In this case, multiplier 806 may be any number from 1 to 6. Multiplier 806 may include a third index multiplier 811 and a ninth index multiplier 817. Multiplier 806 may be any item of value (e.g., free spins, credit amounts, concert tickets, etc.).

Normalized bet category 808 may be a structure, which normalizes the wagers placed by a player.

Each item may be utilized in a scripted scenario. For example, a scripted scenario that had item values of 3, 9, 16, and 22 may determine that the presentation utilizes a red weapon (e.g., fourth red weapon 809), a 6 multiplier (e.g., third index multiplier 811), a blue weapon (e.g., second blue weapon 815), a 3 multiplier (e.g., ninth index multiplier 817), a red pirate (e.g., second red pirate 821), a 10 normalized betting category (e.g., second normalized betting category 823), a blue pirate (e.g., second blue pirate 827), and/or a 35 normalized betting category (e.g., eighth normalized betting category 829).

FIG. 9 is another illustration of scripted scenario building blocks 900, according to one embodiment. Scripted scenario building blocks 900 may include a first script element category 920, a second script element category 922, a third script element category 924, a fourth script element category 926, a fifth script element category 928, a sixth script element category 930, and a seventh script element category 932.

Each script element category may relate to one or more characters (e.g., red pirate, blue pirate, green boat, green car, a first actor, a second actor, etc.), one or more items (e.g., an ax, a bow, a gun, a shovel, car, boat, etc.), and/or one or more value amounts (e.g., multipliers, free spins, credit amounts, and/or any other item of value).

For example, first script element category 920 may relate to a first weapon (e.g., weapon of type A (e.g., a gun, a bow, etc.)). First script element category 920 may have sub-elements. Each script element category may include an index group 902, an index value 904, a type 906, a type value 908, a position 910, a position value 912, a prize 914, and a prize value 916.

For the first sub-element in first script element category 920, index group 902 may show which group this sub-element relates to by having a value of 0 in located in index value 904. In addition, type 908 may show which type this sub-element relates to by having a value of X in type value 908. Further, the location of sub-element may be found by the letter A being located in position value 912. The prize value may be found because there is a 1 located in prize value 916.

There are numerous variations that may be utilized with these sub-elements. For example, second script element category 922 may include 4 sub-elements. The first sub-element may have a 4 in index value 904, a B in type value 908, an E in position value, and a 5 in prize value 916. Each of these values (e.g., 4, B, E, and 5) indicates one or more characteristics of the first sub-element in second script element category 922.

For example, third script element category 924 may include 4 sub-elements. The second sub-element may have a 9 in index value 904, an R in type value 908, an AZ in position value, and a 10 in prize value 916. Each of these values (e.g., 9, R, AZ, and 10) indicates one or more characteristics of the second sub-element in third script element category 924.

For example, fourth script element category 926 may include 3 sub-elements. The third sub-element may have a 14 in index value 904, an ABC in type value 908, a 10 in position value, and a 1 BC in prize value 916. Each of these values (e.g., 14, ABC, 10, and 1 BC) indicates one or more characteristics of the third sub-element in fourth script element category 926.

For example, fifth script element category 928 may include 3 sub-elements. The first sub-element may have a 15 in index value 904, a 1RT in type value 908, an A in position value, and an A in prize value 916. Each of these values (e.g., 15, 1RT, A, and A) indicates one or more characteristics of the first sub-element in fifth script element category 928.

For example, sixth script element category 930 may include 3 sub-elements. The third sub-element may have a 20 in index value 904, a 3 in type value 908, a 22 in position value, and a CC in prize value 916. Each of these values (e.g., 20, 3, 22, and CC) indicates one or more characteristics of the third sub-element in sixth script element category 930.

For example, seventh script element category 932 may include 3 sub-elements. The second sub-element may have a 22 in index value 904, a "-" in type value 908, a "?" in position value, and a "%" in prize value 916. Each of these values (e.g., 22, -, ?, and %) indicates one or more characteristics of the second sub-element in seventh script element category 926.

For example, 22 may indicate that for pirates of color C this is the $22^{nd}$ script. In another example, "-" may indicate the size (e.g., big, small, medium, huge, etc.) of pirates of color C. In another example, "?" may indicate that the pirates of color C are located close together, far apart, at a specific position, and/or any other positional data. In another example, "%" may indicate that a multiplier of 5×, 3 free spins, and/or 1000 credits may be utilized.

Figure 10A:
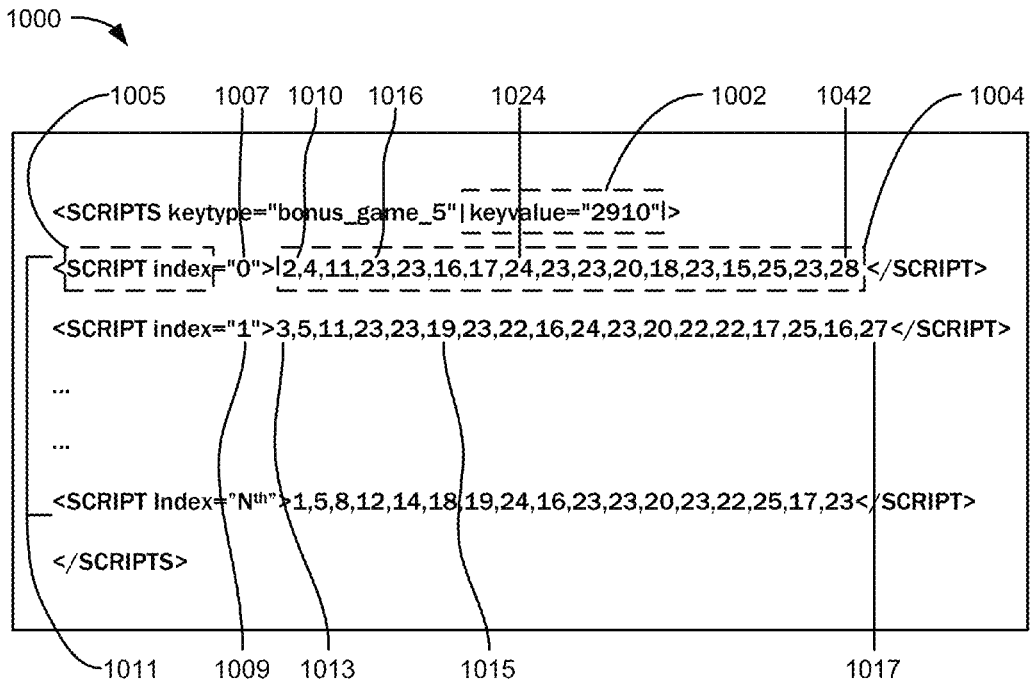
FIG. 10A is an illustration of various scripted scenarios, according to one embodiment.

FIG. 10A is an illustration of various scripted scenarios 1000, according to one embodiment. Various scripted scenarios 1000 may include a key value 1002 and one or more script indexes 1011. One or more script indexes 1011 may include index values for 0 to N. One or more script indexes 1011 may be labeled by a script index 1005. Each script index may include a script index value and an element grouping 1004.

For example, the script index with a value of 0 (e.g., a first index value 1007) from one or more script indexes 1011 may include element grouping 1004, which may include one or more elements. In this example, these one or more elements may include 2, 4, 11, 23, 16, 17, 24, 23, 23, 20, 18, 23, 15, 25, 23, and 28. For easy of illustration, only a first element 1010 (e.g., 2), a fourth element 1016 (e.g., 23), an eighth element 1024 (e.g., 24), and a seventeenth element 1042 (e.g., 28) have individual reference numbers in FIG. 10A.

In one example, the system and/or method may determine that key value 1002 is 2,910 credits. Key value 1002 may be the amount of credits (and/or multipliers and/or free spins and/or any other item of value) won. In this example, the 2,910 credit key value number may be utilized to determine one or more scripts associated with this 2,910 credits key value number (e.g., key value 1002). In this example, there is script indexes numbered 0 to N associated with the 2,910 credits key value number.

The system and/or method may randomly determine which script index (e.g., 0 to N) to utilize. The system and/or method may have a predetermined pattern of which script index (e.g., 0 to N) to utilize. The system and/or method may vary how the script index is determined (e.g., random, predetermined pattern, shuffle, game history, etc.).

In one example, the script index with a value of 0 may be utilized. In this example, the presentation shown to the player may be based on element grouping 1004 related to the 0 script index. These one or more elements may include 2, 4, 11, 23, 16, 17, 24, 23, 23, 20, 18, 23, 15, 25, 23, and 28.

In this example, first element 1010 (e.g., 2) may represent a medium sized red pirate moving from a first position in a first pattern. Fourth element 1016 (e.g., 23) may represent a large sized red pirate moving from a second position in a second pattern. Eighth element 1024 (e.g., 24) may represent a red supersized cross-bow aimed at a first position and having a first firing pattern. Seventeenth element 1042 (e.g., 28) may represent a blue small sized boat moving from a first position, in a first pattern, and able to pick up a small sized load.

In another example, the script index with a value of 1 may be utilized. In this example, the presentation shown to the player may be based on element grouping related to the 1 (e.g., a second script 1009) script index. These one or more elements may include 3, 5, 11, 23, 23, 19, 23, 22, 16, 24, 23, 20, 22, 22, 17, 25, 16, and 27. In this example, the script may include a first second script element 1013 (e.g., 3), a sixth second script element 1015 (e.g., 19), and an eighteenth second script element 1017 (e.g., 27).

First second script element 1013 (e.g., 3) may be a brown haired medium sized person moving from a first position, at a first speed, and in a first pattern. Sixth second script element 1015 (e.g., 19) may be a blonde haired small sized person moving from a second position, at a second speed, and in a second pattern. Eighteenth second script element 1017 (e.g., 27) may be an animal (e.g., dog) moving from a third position, at a third speed, and in a third pattern. In should be noted that these individual elements may interact in the presentation. Further, the elements may be audio (e.g., car engine, gun shot, dog barking, person talking, etc.) and/or visual elements.

Figure 10B:
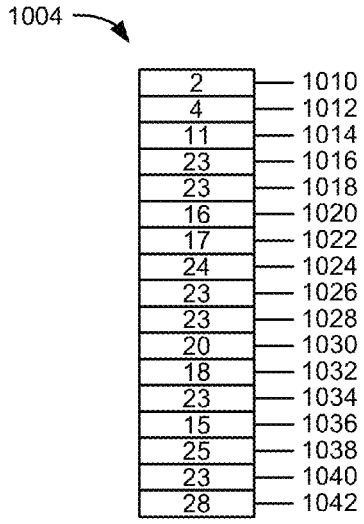
FIG. 10B is an illustration of the elements of one scripted scenario, according to one embodiment.

FIG. 10B is an illustration of the elements of one scripted scenario 1004, according to one embodiment. First index value 1007 may include element grouping 1004, which may include the values 2, 4, 11, 23, 16, 17, 24, 23, 23, 20, 18, 23, 15, 25, 23, and 28. These values may relate to first element 1010, a second element 1012 (e.g., 4), a third element 1014 (e.g., 11), fourth element 1016 (e.g., 23), a fifth element 1018 (e.g., 23), a sixth element 1020 (e.g., 16), a seventh element 1022 (e.g., 17), an eighth element 1024 (e.g., 24), a ninth element 1026 (e.g., 23), a tenth element 1028 (e.g., 23), an eleventh element 1030 (e.g., 20), a twelfth element 1032 (e.g., 18), a thirteenth element 1034 (e.g., 23), a fourteenth element 1036 (e.g., 15), a fifteenth element 1038 (e.g., 25), a sixteenth element 1040 (e.g., 23) and a seventeenth element 1042 (e.g., 28).

In this example, each element (e.g., 1010-1042) may represent an audio and/or visual element in the presentation. In this example, first element 1010 may indicate that a blue pirate enters the presentation, then second element 1012 may indicate that a red pirate enters the presentation, and third element 1014 may indicate that a dog enters the presentation barking. The presentation may continue with fourth element 1016 indicating that a green pirate enters the presentation. This may continue with fifth element 1018 indicating that another green pirate enters the presentation. Sixth element 1020 may indicate that a cross bow was fired, which may have eliminated a green pirate. Seventh element 1022 may indicate that a gun was fired, which may have eliminated a red pirate. Eighth element 1024 may indicate that a fire ball was launched, which may have eliminated a blue pirate. Ninth element 1026 may indicate that another green pirate enters the presentation. Tenth element 1028 may indicate that another green pirate enters the presentation. Eleventh element 1030 may indicate that a trap door was sprung under a green pirate, which may have eliminated a green pirate. Twelfth element 1032 may indicate a net has caught one or more green pirates, which may have eliminated one or more green pirates. Thirteenth element 1034 may indicate that another green pirate enters the presentation. Fourteenth element 1036 may indicate that a multiplier has entered the presentation. Fifteenth element 1038 may indicate that a boat has picked up one or more green pirates, which may have eliminated one or more green pirates. Sixteenth element 1040 may indicate that another green pirate enters the presentation. Seventeenth element 1042 may indicate that the presentation will end with a first ending presentation.

Figure 11:
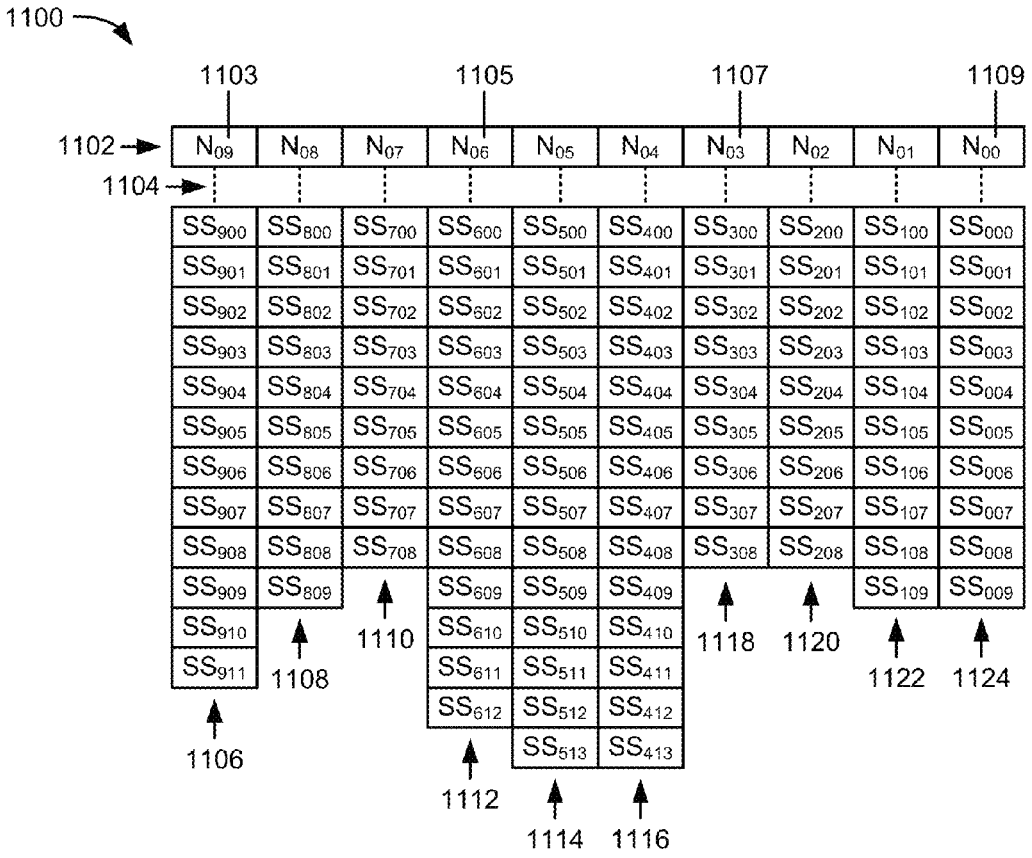
FIG. 11 is an illustration of numerous award amounts with varying scripted scenarios, according to one embodiment.

FIG. 11 is an illustration of numerous award amounts with varying scripted scenarios 1100, according to one embodiment. Varying scripted scenarios 1100 may include one or more key values 1102 (e.g., 0 to N). In this example, there are ten key value numbers $N_{00}$, $N_{01}$, $N_{02}$, $N_{03}$, $N_{04}$, $N_{05}$, $N_{06}$, $N_{07}$, $N_{08}$, and $N_{09}$. Key values may be the amount of credits, multipliers, free spins, and/or any other item which may be utilized to determine one or more scripts to be utilized as the basis for the presentation. For each key value there may be one or more sets of scripted scenarios, which may include one or more scripted scenarios.

For example, there may be a first set of scripted scenarios 1106, a second set of scripted scenarios 1108, a third set of scripted scenarios 1110, a fourth set of scripted scenarios 1112, a fifth set of scripted scenarios 1114, a sixth set of scripted scenarios 1116, a seventh set of scripted scenarios 1118, an eighth set of scripted scenarios 1120, a tenth set of scripted scenarios 1122, and an eleventh set of scripted scenarios 1124.

First set of scripted scenarios 1106 may include one or more scripted scenarios. In this example, first set of scripted scenarios 1106 includes twelve scripted scenarios, which may be labeled as $SS_{900}$, $SS_{901}$, $SS_{902}$, $SS_{903}$, $SS_{904}$, $SS_{905}$, $SS_{906}$, $SS_{907}$, $SS_{908}$, $SS_{909}$, $SS_{910}$, and $SS_{911}$.

Second set of scripted scenarios 1108 may include one or more scripted scenarios. In this example, second set of scripted scenarios 1108 includes ten scripted scenarios, which may be labeled as $SS_{800}$, $SS_{801}$, $SS_{802}$, $SS_{803}$, $SS_{804}$, $SS_{805}$, $SS_{806}$, $SS_{807}$, $SS_{808}$, and $SS_{809}$.

Third set of scripted scenarios 1110 may include one or more scripted scenarios. In this example, third set of scripted scenarios 1110 includes nine scripted scenarios, which may be labeled as $SS_{700}$, $SS_{701}$, $SS_{702}$, $SS_{703}$, $SS_{704}$, $SS_{705}$, $SS_{706}$, $SS_{707}$, and $SS_{708}$.

Fourth set of scripted scenarios 1112 may include one or more scripted scenarios. In this example, fourth set of scripted scenarios 1112 includes thirteen scripted scenarios, which may be labeled as $SS_{600}$, $SS_{601}$, $SS_{602}$, $SS_{603}$, $SS_{604}$, $SS_{606}$, $SS_{606}$, $SS_{607}$, $SS_{608}$, $SS_{609}$, $SS_{610}$, $SS_{611}$, and $SS_{612}$.

Fifth set of scripted scenarios 1114 may include one or more scripted scenarios. In this example, fifth set of scripted scenarios 1114 includes fourteen scripted scenarios, which may be labeled as $SS_{500}$, $SS_{501}$, $SS_{502}$, $SS_{503}$, $SS_{504}$, $SS_{506}$, $SS_{506}$, $SS_{507}$, $SS_{508}$, $SS_{509}$, $SS_{510}$, $SS_{511}$, $SS_{512}$, and $SS_{513}$.

Sixth set of scripted scenarios 1116 may include one or more scripted scenarios. In this example, fifth set of scripted scenarios 1116 includes fourteen scripted scenarios, which may be labeled as $SS_{400}$, $SS_{401}$, $SS_{402}$, $SS_{403}$, $SS_{404}$, $SS_{405}$, $SS_{406}$, $SS_{407}$, $SS_{408}$, $SS_{409}$, $SS_{410}$, $SS_{411}$, $SS_{412}$, and $SS_{413}$.

Seventh set of scripted scenarios 1118 may include one or more scripted scenarios. In this example, seventh set of scripted scenarios 1118 includes nine scripted scenarios, which may be labeled as $SS_{300}$, $SS_{301}$, $SS_{302}$, $SS_{303}$, $SS_{304}$, $SS_{305}$, $SS_{306}$, $SS_{307}$, and $SS_{308}$.

Eighth set of scripted scenarios 1120 may include one or more scripted scenarios. In this example, eighth set of scripted scenarios 1120 includes nine scripted scenarios, which may be labeled as $SS_{200}$, $SS_{201}$, $SS_{202}$, $SS_{203}$, $SS_{204}$, $SS_{205}$, $SS_{206}$, $SS_{207}$, and $SS_{208}$.

Ninth set of scripted scenarios 1122 may include one or more scripted scenarios. In this example, ninth set of scripted scenarios 1122 includes ten scripted scenarios, which may be labeled as $SS_{100}$, $SS_{101}$, $SS_{102}$, $SS_{103}$, $SS_{104}$, $SS_{105}$, $SS_{106}$, $SS_{107}$, $SS_{108}$, and $SS_{109}$.

Tenth set of scripted scenarios 1124 may include one or more scripted scenarios. In this example, tenth set of scripted scenarios 1124 includes ten scripted scenarios, which may be labeled as $SS_{000}$, $SS_{001}$, $SS_{002}$, $SS_{003}$, $SS_{004}$, $SS_{005}$, $SS_{006}$, $SS_{007}$, $SS_{008}$, and $SS_{009}$.

In one example, a first key value 1103 (e.g., $N_{09}$) may be indexed to first set of scripted scenarios 1106, which may include one or more scripted scenarios. In this example, first set of scripted scenarios 1106 may include twelve scripted scenarios, which may be labeled as $SS_{900}$, $SS_{901}$, $SS_{902}$, $SS_{903}$, $SS_{904}$, $SS_{905}$, $SS_{906}$, $SS_{907}$, $SS_{908}$, $SS_{909}$, $SS_{910}$, and $SS_{911}$. In this example, first key value 1103 may be 1,000 credits. If a player wins 1,000 credits, then the system and/or method may present a winning presentation based on first key value 1103. The system and/or method may select (e.g., randomly, by a predetermined pattern, shuffle, combination thereof, and/or any other selection method) one or more of the twelve scripted scenarios (e.g., $SS_{900}$, $SS_{901}$, $SS_{902}$, $SS_{903}$, $SS_{904}$, $SS_{905}$, $SS_{906}$, $SS_{907}$, $SS_{908}$, $SS_{909}$, $SS_{910}$, and $SS_{911}$). If $SS_{900}$ is selected the presentation may be based on a first theme (e.g., pirates). If $SS_{901}$ is selected the presentation may be based on a second theme (e.g., cars). If $SS_{902}$ is selected the presentation may be based on a third theme (e.g., horses). If $SS_{903}$ is selected the presentation may be based on a fourth theme (e.g., perceived skill). If $SS_{904}$ is selected the presentation may be based on a fifth theme (e.g., a specific movie). If $SS_{905}$ is selected the presentation may be based on a sixth theme (e.g., a sporting event).

In another example, a second key value 1105 (e.g., $N_{06}$) may be indexed to fourth set of scripted scenarios 1112, which may include one or more scripted scenarios. In this example, fourth set of scripted scenarios 1112 may include thirteen scripted scenarios, which may be labeled as $SS_{600}$, $SS_{601}$, $SS_{602}$, $SS_{603}$, $SS_{604}$, $SS_{605}$, $SS_{606}$, $SS_{607}$, $SS_{608}$, $SS_{609}$, $SS_{610}$, $SS_{611}$, and $SS_{612}$. In this example, second key value 1105 may be 10,000 credits. If a player wins 10,000 credits, then the system and/or method may present a winning presentation based on second key value 1105. The system and/or method may select (e.g., randomly, by a predetermined pattern, shuffle, combination thereof, and/or any other selection method) one or more of the thirteen scripted scenarios (e.g., $SS_{600}$, $SS_{601}$, $SS_{602}$, $SS_{603}$, $SS_{604}$, $SS_{605}$, $SS_{606}$, $SS_{607}$, $SS_{608}$, $SS_{609}$, $SS_{610}$, $SS_{611}$, and $SS_{612}$). If $SS_{600}$ is selected the presentation may be based on a seventh theme (e.g., outer space). If $SS_{601}$ is selected the presentation may be based on an eight theme (e.g., flowers). If $SS_{602}$ is selected the presentation may be based on a ninth theme (e.g., food). If $SS_{603}$ is selected the presentation may be based on a tenth theme (e.g., a skill based presentation). If $SS_{604}$ is selected the presentation may be based on an eleventh theme (e.g., trivia). If $SS_{605}$ is selected the presentation may be based on a twelve theme (e.g., pick a bonus).

In another example, a third key value 1107 (e.g., $N_{03}$) may be indexed to seventh set of scripted scenarios 1118, which may include one or more scripted scenarios. In this example, seventh set of scripted scenarios 1118 may include nine scripted scenarios, which may be labeled as $SS_{300}$, $SS_{301}$, $SS_{302}$, $SS_{303}$, $SS_{304}$, $SS_{305}$, $SS_{306}$, $SS_{307}$, and $SS_{308}$. In this example, third key value 1107 may be 100 credits and/or 3 free spins. If a player wins 100 credits and/or 3 free spins, then the system and/or method may present a winning presentation based on third key value 1107. The system and/or method may select (e.g., randomly, by a predetermined pattern, shuffle, combination thereof, game history, and/or any other selection method) one or more of the thirteen scripted scenarios (e.g., $SS_{300}$, $SS_{301}$, $SS_{302}$, $SS_{303}$, $SS_{304}$, $SS_{305}$, $SS_{306}$, $SS_{307}$, and $SS_{308}$). If $SS_{300}$ is selected the presentation may be based on a thirteenth theme (e.g., ghost). If $SS_{301}$ is selected the presentation may be based on a fourteenth theme (e.g., natural events).

In another example, a fourth key value 1109 (e.g., $N_{00}$) may be indexed to tenth set of scripted scenarios 1124, which may include one or more scripted scenarios. In this example, tenth set of scripted scenarios 1124 may include ten scripted scenarios, which may be labeled as $SS_{000}$, $SS_{001}$, $SS_{002}$, $SS_{003}$, $SS_{004}$, $SS_{005}$, $SS_{006}$, $SS_{007}$, $SS_{008}$, and $SS_{009}$. In this example, fourth key value 1109 may be 2,500 credits, a 2× multiplier, and/or 7 free spins. If a player wins 2,500 credits, a 2× multiplier, and/or 7 free spins, then the system and/or method may present a winning presentation based on fourth key value 1109. The system and/or method may select (e.g., randomly, by a predetermined pattern, shuffle, combination thereof, and/or any other selection method) one or more of the thirteen scripted scenarios (e.g., $SS_{000}$, $SS_{001}$, $SS_{002}$, $SS_{003}$, $SS_{004}$, $SS_{005}$, $SS_{006}$, $SS_{007}$, $SS_{008}$, and $SS_{009}$). If $SS_{000}$ is selected the presentation may be based on a fifteenth theme (e.g., a mineral—gold, silver, etc.). If $SS_{001}$ is selected the presentation may be based on a sixteenth theme (e.g., mythology).

One, a few, a plurality, and/or all of these scripted scenarios may be themed based. Each key value may have any number of scripted scenarios related to the key value. The number of scripted scenarios related to each key value may vary.

Figure 12:
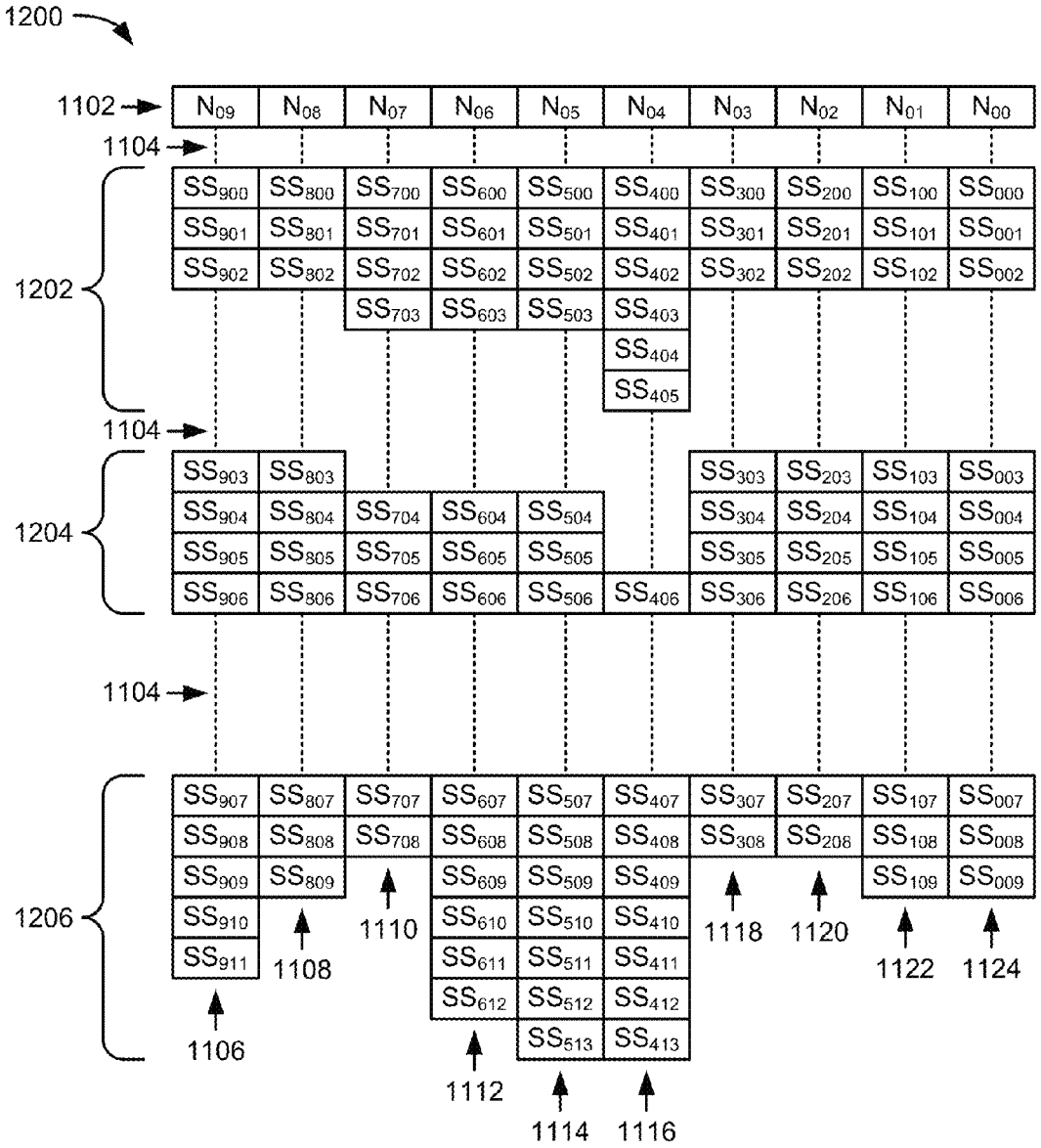
FIG. 12 is another illustration of numerous award amounts with varying scripted scenarios based on wagering amounts, according to one embodiment.

FIG. 12 is another illustration of numerous award amounts with varying scripted scenarios based on wagering amounts 1200, according to one embodiment. Varying scripted scenarios based on wagering amounts 1200 may include one or more key values 1102 (e.g., 0 to N), a first credit amount set of scripts 1202, a second credit amount set of scripts 1204, and a third credit amount set of scripts 1206. The number of scripts in the set of scripts relating to a key value may vary based on the amount a player has wagered.

For example, when a player's wager is a first credit amount and the player has a winning event, which triggers first key value 1103 (e.g., $N_{09}$) the one or more scripted scenarios available to base the presentation on may be $SS_{900}$, $SS_{901}$, and $SS_{902}$.

In another example, when the wager amount is a second credit amount and a winning event occurs, which triggers first key value 1103 (e.g., $N_{09}$) the one or more scripted scenarios available to base the presentation on may be $SS_{900}$, $SS_{901}$, $SS_{902}$, $SS_{903}$, $SS_{904}$, $SS_{905}$, and $SS_{906}$.

In another example, when the wager amount is a third credit amount and a winning event occurs, which triggers first key value 1103 (e.g., $N_{09}$) the one or more scripted scenarios available to base the presentation on may be $SS_{900}$, $SS_{901}$, $SS_{902}$, $SS_{903}$, $SS_{904}$, $SS_{905}$, $SS_{906}$, $SS_{907}$, $SS_{908}$, $SS_{909}$, $SS_{910}$, and $SS_{911}$.

For example, when a player's wager is a first credit amount and the player has a winning event, which triggers second key value 1105 (e.g., $N_{06}$) the one or more scripted scenarios available to base the presentation on may be $SS_{600}$, $SS_{601}$, $SS_{602}$, and $SS_{603}$.

In another example, when the wager amount is a second credit amount and a winning event occurs, which triggers second key value 1105 (e.g., $N_{06}$) the one or more scripted scenarios available to base the presentation on may be $SS_{600}$, $SS_{601}$, $SS_{602}$, $SS_{603}$, $SS_{604}$, $SS_{605}$, and $SS_{606}$.

In another example, when the wager amount is a third credit amount and a winning event occurs, which triggers second key value 1105 (e.g., $N_{06}$) the one or more scripted scenarios available to base the presentation on may be $SS_{600}$, $SS_{601}$, $SS_{602}$, $SS_{603}$, $SS_{604}$, $SS_{605}$, $SS_{606}$, $SS_{607}$, $SS_{608}$, $SS_{609}$, $SS_{610}$, $SS_{611}$, and $SS_{612}$.

For example, when a player's wager is a first credit amount and the player has a winning event, which triggers third key value 1107 (e.g., $N_{03}$) the one or more scripted scenarios available to base the presentation on may be $SS_{300}$, $SS_{301}$, and $SS_{302}$.

In another example, when the wager amount is a second credit amount and a winning event occurs, which triggers third key value 1107 (e.g., $N_{03}$) the one or more scripted scenarios available to base the presentation on may be $SS_{300}$, $SS_{301}$, $SS_{302}$, $SS_{303}$, $SS_{304}$, $SS_{305}$, and $SS_{306}$.

In another example, when the wager amount is a third credit amount and a winning event occurs, which triggers third key value 1107 (e.g., $N_{03}$) the one or more scripted scenarios available to base the presentation on may be $SS_{300}$, $SS_{301}$, $SS_{302}$, $SS_{303}$, $SS_{304}$, $SS_{305}$, $SS_{306}$, $SS_{307}$, and $SS_{308}$.

For example, when a player's wager is a first credit amount and the player has a winning event, which triggers fourth key value 1109 (e.g., $N_{00}$) the one or more scripted scenarios available to base the presentation on may be $SS_{000}$, $SS_{001}$, and $SS_{002}$.

In another example, when the wager amount is a second credit amount and a winning event occurs, which triggers fourth key value 1109 (e.g., $N_{00}$) the one or more scripted scenarios available to base the presentation on may be $SS_{000}$, $SS_{001}$, $SS_{002}$, $SS_{003}$, $SS_{004}$, $SS_{005}$, and $SS_{006}$.

In another example, when the wager amount is a third credit amount and a winning event occurs, which triggers fourth key value 1109 (e.g., $N_{00}$) the one or more scripted scenarios available to base the presentation on may be $SS_{000}$, $SS_{001}$, $SS_{002}$, $SS_{003}$, $SS_{004}$, $SS_{005}$, $SS_{006}$, $SS_{007}$, $SS_{008}$, and $SS_{009}$.

Figure 13:
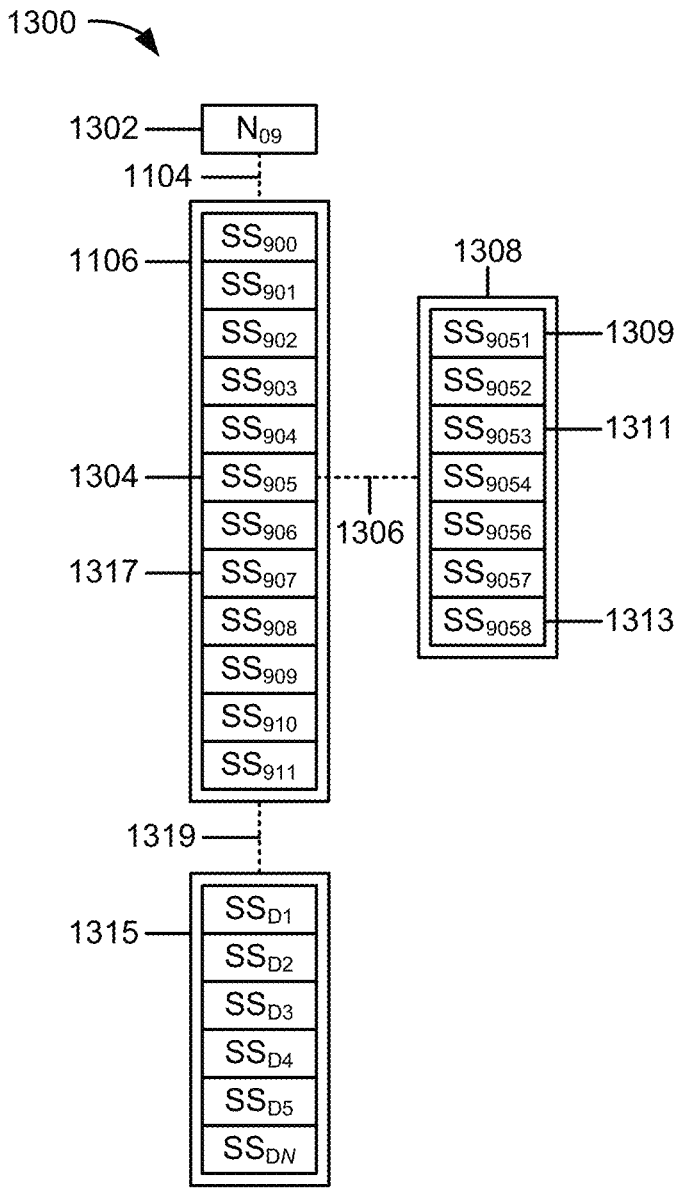
FIG. 13 is another illustration of various scripted scenarios, according to one embodiment, according to one embodiment.

FIG. 13 is another illustration of numerous award amounts with varying scripted scenarios 1300, according to one embodiment. A key value 1302 may be related via a link 1104 to first set of scripted scenarios 1106. Key value 1302 may be dynamically relating via a dynamic link 1319 to a dynamic set of scripted scenarios 1315. First set of scripted scenarios 1106 may include a triggering script 1304 and a favorite script 1317.

Dynamic set of scripted scenarios 1315 may be scripted scenarios, which are activated (e.g., able to be utilized as a basis for a presentation) based on a triggering event. The triggering event may be a player level (e.g., silver, gold, platinum, etc.), a playing time period, a promotion, player points, an amount won, an amount lost, a time of day, a time of week, game history, any other criteria, and/or any combination thereof.

Triggering script 1304 may be a scripted scenario, which activates (e.g., able to be utilized as a basis for a presentation) other scripted scenarios based on triggering script 1304 being selected. Expandable script 1308 may be related to triggering script 1304 via an expandable link 1306. Expandable script 1308 may be scripted scenarios based on the casino property, a player's preference (e.g., the player is a Philadelphia Eagles fan and the presentation is based on this data), a third party advertisement (e.g., White bears for a soda company), a movie trailer, a video game theme, a script that utilizes the player's image, etc.

Favorite script 1317 may be a script that the player has indicated is a preferred script. Favorite script 1317 may be weighted so that favorite script 1317 is activated more frequently than the base program would dictate.

Figure 14:
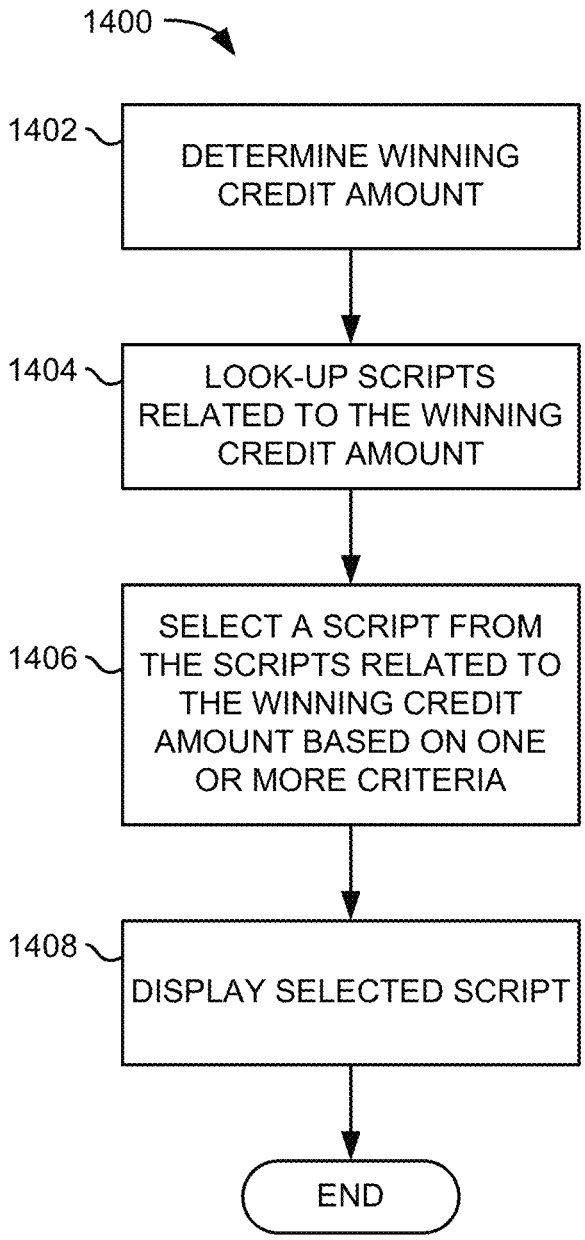
FIG. 14 is a flow diagram for generating scripted scenarios, according to one embodiment.

FIG. 14 is a flow diagram for generating scripted scenarios 1400, according to one embodiment. The method may include determining a triggering event (e.g., a winning credit amount) (step 1402). The method may include looking up one or more scripts relating to the triggering event (e.g., a winning credit amount) (step 1404). The method may include selecting a script from the one or more scripts related to the triggering event (e.g., a winning credit amount) based on one or more criteria (step 1406). The method may include displaying the selected scripted scenario (step 1408). The method may end.

In one example, the system and/or method may determine that key value (e.g., winning amount) is 10,000 credits. The key value may be the amount of credits (and/or multipliers and/or free spins and/or any other item of value) won. In this example, the 10,000 credit key value number may be utilized to determine one or more scripts associated with this 10,000 credits key value number. There may be script indexes numbered 0 to N associated with the 10,000 credits key value number. These script indexes may have various scripted scenario themes, which may include a first theme (e.g., pirates), a second theme (e.g., cars), a third theme (e.g., horses), a fourth theme (e.g., perceived skill), a fifth theme (e.g., a specific movie), a sixth theme (e.g., a sporting event), a seventh theme (e.g., outer space), an eight theme (e.g., flowers), a ninth theme (e.g., food), a tenth theme (e.g., a skill based presentation), an eleventh theme (e.g., trivia), a twelve theme (e.g., pick a bonus), a thirteenth theme (e.g., ghost), a fourteenth theme (e.g., natural events), a fifteenth theme (e.g., a mineral—gold, silver, etc.), a sixteenth theme (e.g., mythology), and an Nth theme.

The system and/or method may select (e.g., randomly, by a predetermined pattern, shuffle, combination thereof, and/or any other selection method) one or more of the scripted scenarios.

Figure 15:
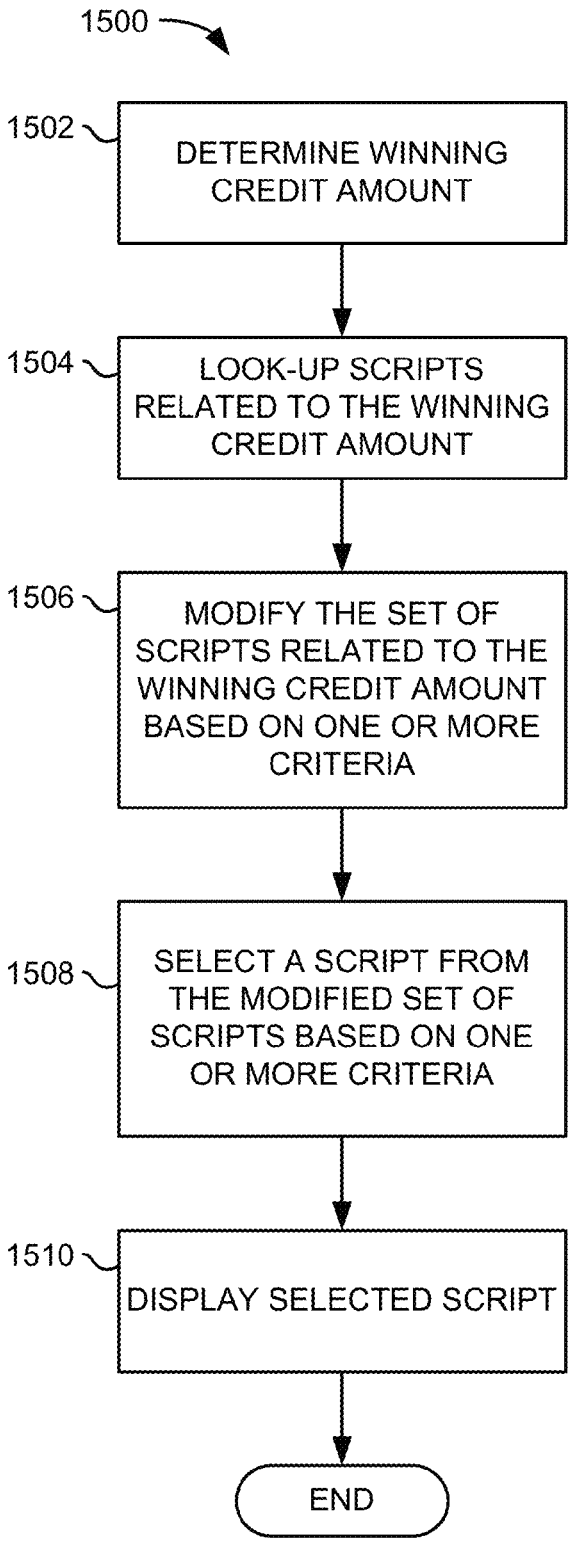
FIG. 15 is another flow diagram for generating scripted scenarios, according to one embodiment.

FIG. 15 is another flow diagram for generating scripted scenarios 1500, according to one embodiment. The method may include determining a winning credit amount (step 1502). The method may include looking up one or more scripts related to the winning credit amount (step 1504). The method may include modifying the set of scripts relating to the winning credit amount based on one or more criteria (step 1506). The method may include selecting a script from the modified set of scripts based on one or more criteria (step 1508). The method may include displaying the selected script (step 1510). The method may end.

For example, the script may be modified to include an advertisement, a movie trailer, a movie promotion, a casino event, a casino promotion, an actor's image, the player's image, etc.

Figure 16:
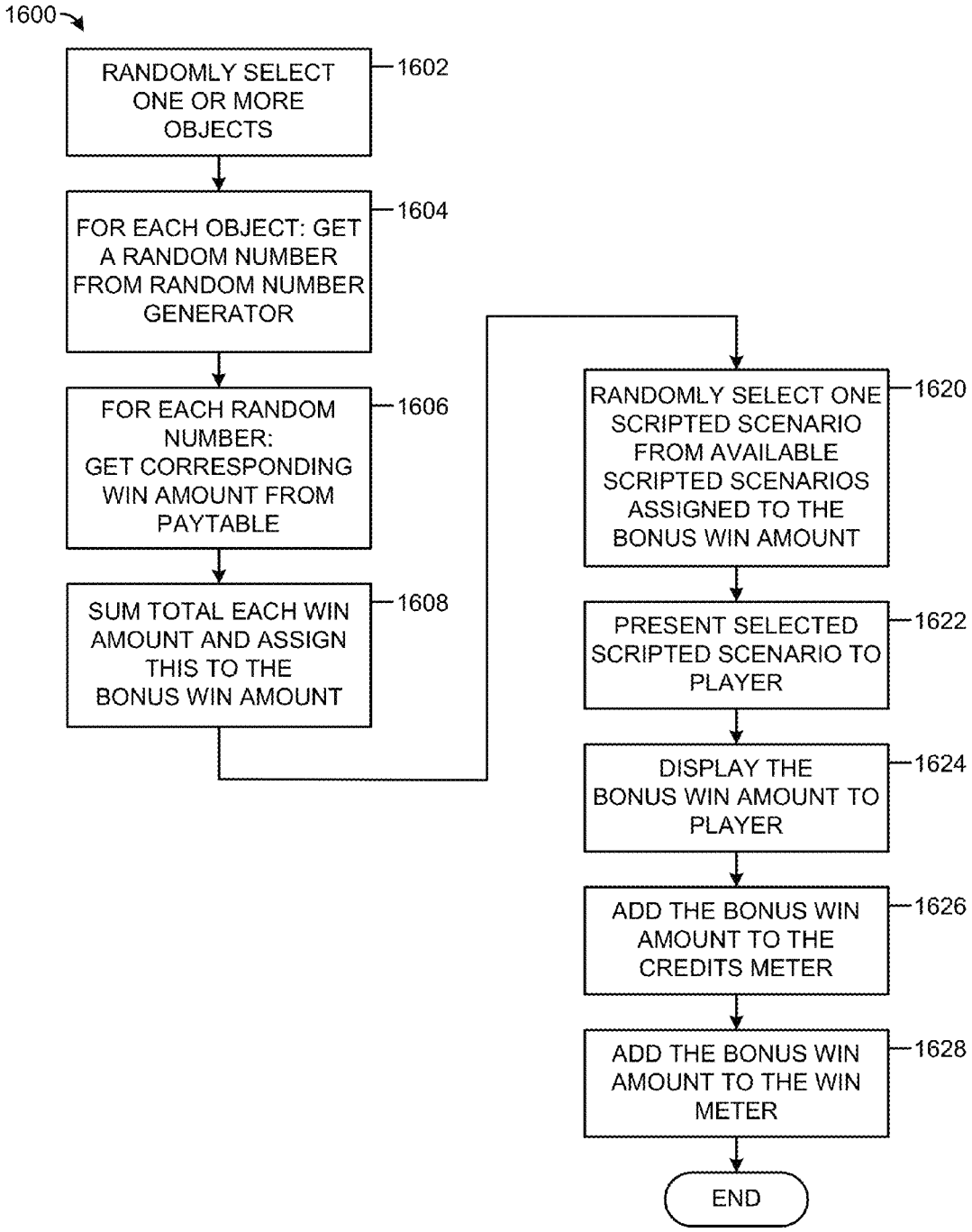
FIG. 16 is another flow diagram for a scripted scenario game play, according to one embodiment

FIG. 16 is another flow diagram for a scripted scenario game play 1600, according to one embodiment. The method may include the starting of the game. The method may include randomly selecting one or more objects (step 1602). The method may include for each object generating a random number from a random number generator (step 1604). The method may include for each random number obtaining a corresponding win amount from the paytable (step 1606). The method may including summing the total of each win amount and assigning this win amount to the bonus win amount (step 1608). The method may include selecting (e.g., randomly, by a predetermined pattern, etc.) one scripted scenario from the available scripted scenarios assigned to the bonus win amount (step 1620). The method may include presenting the selected scripted scenario to the player (step 1622). The method may include displaying the bonus win amount to the player (step 1624). The method may include adding the bonus win amount to the credits meter (step 1626). The method may include adding the bonus win amount to the win meter (step 1628). The method may then end.

In one embodiment, the electronic gaming device may include a plurality of reels, one or more paylines formed on at least a portion of the plurality of reels, a memory, and a processor. The memory may include a script module. The script module may include a plurality of scripted scenarios. The processor may determine a key value. The processor may select one or more scripted scenarios based on the key value.

In another example, the processor may randomly select the one or more scripted scenarios related to the key value. In an example, the processor may select the one or more scripted scenarios related to the key value in a predetermined pattern.

In another example, the key value may be based on an input from a player. In an example, the processor may display a presentation based on one or more scripted scenarios. In another example, the processor may display a themed presentation based on one or more scripted scenarios. In an example, the themed presentation may be based on an advertisement and/or any other theme.

In another embodiment, the method of providing gaming options via an electronic gaming device may include receiving one or more primary wagers on one or more paylines, determining one or more key values, and/or selecting one or more scripted scenarios based on the one or more key values.

In another example, the method may include that the selecting of the one or more scripted scenarios is randomly generated. In an example, the method may include that the selecting of the one or more scripted scenarios is generated in a predetermined pattern.

In another example, the method may include obtaining an input from a player and/or basing a determined one or more key values on the input. In an example, the method may include displaying a presentation based on one or more scripted scenarios. The method may include displaying a themed presentation based on one or more scripted scenarios. The themed presentation may be based on a movie content and/or any other theme.

In another embodiment, the electronic gaming system may include a server, which may include a server memory and a server processor. The server memory may include a plurality of scripted scenarios. The server processor may determine a key value. The server processor may select one or more scripted scenarios based on the key value.

In one example, the server processor may randomly select the one or more scripted scenarios related to the key value. In another example, the server processor may select the one or more scripted scenarios related to the key value in a predetermined pattern.

In another example, the key value may be based on an input from a player. The server processor may display a presentation based on one or more scripted scenarios. The server processor may display a themed presentation based on one or more scripted scenarios.

In an exemplary embodiment, an electronic gaming device may include a plurality of reels. The plurality of reels may include a plurality of symbols. The electronic gaming device may include a first payline, a second payline, and a memory. The memory may include a payline module. The payline module may include a plurality of payline structures. The electronic gaming device may include a processor. The processor may receive primary wagers on one or more paylines. The processor may receive one or more secondary wagers on one or more selected paylines (e.g., repeat paylines, patterns, scenarios, etc.). The selected paylines may be based on data received from a player. The processor may determine a selected payline's payout based on the one or more selected paylines (e.g., repeat paylines, patterns, scenarios, etc.).

In another embodiment, the processor may determine a payout based on the primary wagers. The electronic gaming device may include a network interface, which may receive data from at least one of a server and one or more gaming devices. The electronic gaming device may include a display, which may display one or more selected paylines.

In another example, the display may shade one or more non-selected paylines. The electronic gaming device may include a player preference input device. The player preference input device may modify a game configuration based on data from an identification device. The processor may multiply a prize value based on a selected payline occurrence.

In another embodiment, a method of game play may include receiving one or more primary wagers on one or more paylines. The method may include receiving a secondary wager on one or more paylines (e.g., repeat paylines, patterns, scenarios, etc.). The selected payline may be based on selection data. The selection data may be based on player input. The method may include determining one or more primary wager payouts. Further, the method may include determining one or more secondary wager payouts.

In another example, the method may include obtaining a player preference data and modifying a game configuration based on the player preference data. The method may include receiving data from at least one of a server and one or more gaming devices. The method may include multiplying a prize value based on a selected payline occurrence.

In another embodiment, the electronic gaming system may include a server. The server may include a server memory and a server processor. The server may receive primary wagers on one or more paylines. The server processor may receive one or more secondary wagers on one or more selected paylines (e.g., repeat paylines, patterns, scenarios, etc.). The selected paylines may be based on data received from a player. The server processor may determine a selected paylines payout based on the one or more selected paylines. The server memory may include a payline module. The payline module may include a plurality of payline structures.

In another example, the server processor may determine a payout based on the primary wagers. The server processor via a display may display one or more selected paylines. The display may shade one or more non-selected paylines.

In one embodiment, the electronic gaming device may include a plurality of reels. The plurality of reels may include a plurality of symbols. One or more paylines may be formed on a portion of the plurality of reels. The electronic gaming device may include a memory. The memory may include a payline module. The payline module may include a plurality of payline structures. The electronic gaming device may include a processor, which receives primary wagers on one or more paylines. The processor may also receive one or more secondary wagers on one or more repeat paylines. The processor may determine one or more repeat payline payouts based on the one or more repeat paylines.

In another example, the processor may determine a payout based on the primary wagers. The processor may receive one or more secondary wagers on one or more patterns. The electronic gaming device may include a display, which may display a game status image.

In another example, the display may shade one or more completed repeat paylines. The electronic gaming device may include a player preference input device. The player preference input device may modify a game configuration based on data from an identification device. In another embodiment, the processor may multiply a prize value based on a repeat payline occurrence.

In an embodiment, a method may include receiving one or more primary wagers on one or more paylines. The method may include receiving a secondary wager on one or more repeat paylines. The method also may include determining one or more primary wager payouts. The method may include determining one or more secondary wager payouts.

In another example, a primary wager payout may be based on the one or more paylines and a secondary wager payout may be based on the one or more repeat paylines. The method may include receiving one or more secondary wagers on one or more patterns.

In another example, the method may include displaying a game status image. The method may also include shading one or more completed repeat paylines.

In another example, the method may include displaying paylines based on the one or more primary wagers. The method may include displaying the one or more repeat paylines. The method may include highlighting one or more repeat paylines. The method may include obtaining a player preference data and modifying a game configuration based on the player preference data.

In another embodiment, the electronic gaming system may include a server. The server may include a server memory, a server processor, and a signage server. The server memory may include historical gaming data. The server processor may generate a gaming message based on the historical gaming data. The signage server may transmit the gaming message.

In another example, the gaming message may be transmitted to an internal display of a gaming entity. The internal display may be a non-gaming device display. The gaming message may be transmitted to an external display of a gaming entity. The external display may be located outside of a gaming entity. The gaming message may be transmitted to at least one of a top display, a main display, and a side display.

The plurality of reels may form a 5-by-5 matrix, a 3-by-5 matrix, a 4-by-5 matrix, a 4-by-3 matrix, a 5-by-3 matrix, or any number-by-any number matrix. The symbols may be an image of a card, an image, and/or other objects. For example, it could be a pot of gold, an ace of spades, a diamond, or any other symbol. The symbols may be animation. The symbols may be a picture. For example, it may be a picture of the player as taken by camera 312. The symbols may be a number. The symbols may be any image. The symbols may be blank.

This repeat payline feature, the pattern feature, and/or the scenario feature may be part of the base game and/or a bonus game. In addition, this repeat payline feature, the pattern feature, and/or the scenario feature may be part of a base bet and/or may require an additional side bet (e.g., ante bet).

Gaming system may be a "state-based" system. A state-based system stores and maintains the system's current state in a non-volatile memory. Therefore, if a power failure or other malfunction occurs, the gaming system will return to the gaming system's state before the power failure or other malfunction occurred when the gaming system is powered up.

State-based gaming systems may have various functions (e.g., wagering, payline selections, reel selections, game play, bonus game play, evaluation of game play, game play result, steps of graphical representations, etc.) of the game. Each function may define a state. Further, the gaming system may store game histories, which may be utilized to reconstruct previous game plays.

A state-based system is different than a Personal Computer ("PC") because a PC is not a state-based machine. A state-based system has different software and hardware design requirements as compared to a PC system.

The gaming system may include random number generators, authentication procedures, authentication keys, and operating system kernels. These devices, modules, software, and/or procedures may allow a gaming authority to track, verify, supervise, and manage the gaming system's codes and data.

A gaming system may include state-based software architecture, state-based supporting hardware, watchdog timers, voltage monitoring systems, trust memory, gaming system designed communication interfaces, and security monitoring.

For regulatory purposes, the gaming system may be designed to prevent the gaming system's owner from misusing (e.g., cheating) via the gaming system. The gaming system may be designed to be static and monolithic.

In one example, the instructions coded in the gaming system are non-changeable (e.g., static) and are approved by a gaming authority and installation of the codes are supervised by the gaming authority. Any change in the system may require approval from the gaming authority. Further, a gaming system may have a procedure/device to validate the code and prevent the code from being utilized if the code is invalid. The hardware and software configurations are designed to comply with the gaming authorities' requirements.

As used herein, the term "mobile device" refers to a device that may from time to time have a position that changes. Such changes in position may comprise of changes to direction, distance, and/or orientation. In particular examples, a mobile device may comprise of a cellular telephone, wireless communication device, user equipment, laptop computer, other personal communication system ("PCS") device, personal digital assistant ("PDA"), personal audio device ("PAD"), portable navigational device, or other portable communication device. A mobile device may also comprise of a processor or computing platform adapted to perform functions controlled by machine-readable instructions.

The methods and/or methodologies described herein may be implemented by various means depending upon applications according to particular examples. For example, such methodologies may be implemented in hardware, firmware, software, or combinations thereof. In a hardware implementation, for example, a processing unit may be implemented within one or more application specific integrated circuits ("ASICs"), digital signal processors ("DSPs"), digital signal processing devices ("DSPDs"), programmable logic devices ("PLDs"), field programmable gate arrays ("FPGAs"), processors, controllers, micro-controllers, microprocessors, electronic devices, other devices units designed to perform the functions described herein, or combinations thereof.

Some portions of the detailed description included herein are presented in terms of algorithms or symbolic representations of operations on binary digital signals stored within a memory of a specific apparatus or a special purpose computing device or platform. In the context of this particular specification, the term specific apparatus or the like includes a general purpose computer once it is programmed to perform particular operations pursuant to instructions from program software. Algorithmic descriptions or symbolic representations are examples of techniques used by those of ordinary skill in the arts to convey the substance of their work to others skilled in the art. An algorithm is considered to be a self-consistent sequence of operations or similar signal processing leading to a desired result. In this context, operations or processing involve physical manipulation of physical quantities. Typically, although not necessarily, such quantities may take the form of electrical or magnetic signals capable of being stored, transferred, combined, compared or otherwise manipulated. It has proven convenient at times, principally for reasons of common usage, to refer to such signals as bits, data, values, elements, symbols, characters, terms, numbers, numerals, or the like. It should be understood, however, that all of these or similar terms are to be associated with appropriate physical quantities and are merely convenient labels. Unless specifically stated otherwise, as apparent from the discussion herein, it is appreciated that throughout this specification discussions utilizing terms such as "processing," "computing," "calculating," "determining" or the like refer to actions or processes of a specific apparatus, such as a special purpose computer or a similar special purpose electronic computing device. In the context of this specification, therefore, a special purpose computer or a similar special purpose electronic computing device is capable of manipulating or transforming signals, typically represented as physical electronic or magnetic quantities within memories, registers, or other information storage devices, transmission devices, or display devices of the special purpose computer or similar special purpose electronic computing device.

Reference throughout this specification to "one example," "an example," "embodiment," and/or "another example" should be considered to mean that the particular features, structures, or characteristics may be combined in one or more examples.

While there has been illustrated and described what are presently considered to be example features, it will be understood by those skilled in the art that various other modifications may be made, and equivalents may be substituted, without departing from the disclosed subject matter. Additionally, many modifications may be made to adapt a particular situation to the teachings of the disclosed subject matter without departing from the central concept described herein. Therefore, it is intended that the disclosed subject matter not be limited to the particular examples disclosed.

The invention claimed is:

1. An electronic gaming device, the electronic gaming device comprising:

a credit device configured to accept an item associated with a monetary value;

a plurality of display areas;

one or more paylines formed on at least a portion of the plurality of display areas;

a memory, the memory including a script module, the script module including a plurality of scripted scenarios; and a processor configured to determine a first wager amount for a game play where the first wager amount is subtracted from a credit balance, the credit balance being funded at least in part via the credit device, the processor configured to generate a first determination which is a payout amount based on a generated random number, the processor configured to generate a second determination which is a key value based on the payout amount, the processor further configured to select a first scripted scenario from the plurality of scripted scenarios based on the key value and the first wager amount where the first scripted scenario includes a character element and a weapon element.

2. The electronic gaming device of claim 1, wherein the processor is further configured to randomly select the first scripted scenario from the plurality of scripted scenarios.

3. The electronic gaming device of claim 1, wherein the processor is further configured to select the first scripted scenario from the plurality of scripted scenarios in a predetermined pattern.

4. The electronic gaming device of claim 1, wherein the processor is further configured to select a second scripted scenario from the plurality of scripted scenarios based on the key value and a second wager amount where the first scripted scenario is a non-selectable option based on the second wager amount being utilized.

5. The electronic gaming device of claim 1, wherein the processor is further configured to display a presentation based on the first scripted scenario.

6. The electronic gaming device of claim 1, wherein the processor is further configured to display a themed presentation based on the first scripted scenario.

7. The electronic gaming device of claim 6, wherein the themed presentation is based on an advertisement.

8. A method of providing gaming options via an electronic gaming device, the method comprising:

receiving via a credit device an item associated with a monetary value;

establishing via one or more processors a credit balance based at least in part on the received item;

receiving via a wager button a first wager amount on a play of a game, wherein the first wager amount is deducted from the credit balance;

determining a first determination which is a payout amount based on a generated random number;

determining a second determination which is a key value based on the payout amount; and selecting a first scripted scenario based on the key value and the first wager amount where the scripted scenario includes a character element and a weapon element.

9. The method of claim 8, wherein the selecting of the first scripted scenario is randomly generated.

10. The method of claim 8, wherein the selecting of the first scripted scenario is generated in a predetermined pattern.

11. The method of claim 8, further comprising selecting a second scripted scenario from the plurality of scripted scenarios based on the key value and a second wager amount where the first scripted scenario is a non-selectable option based on the second wager amount being utilized.

12. The method of claim 8, further comprising displaying a presentation based on the first scripted scenario.

13. The method of claim 8, further comprising displaying a themed presentation based on the first scripted scenario.

14. The method of claim 13, wherein the themed presentation is based on a movie content.

15. An electronic gaming system comprising:

a credit device configured to accept an item associated with a monetary value;

a user input device configured to enable a player to select a first wager amount and initiate a game play, wherein the first wager amount is subtracted from a credit balance funded at least in part via the credit device;

a server including a server memory and a server processor, the server memory including a plurality of scripted scenarios;

the server processor configured to determine a first determination which is a payout amount based on a generated random number, the server processor configured to determine a second determination which is a key value based on the payout amount, the server processor further configured to select a first scripted scenario from the plurality of scripted scenarios based on the key value and the first wager amount where the first scripted scenario includes a character element and a weapon element.

16. The electronic gaming system of claim 15, wherein the server processor is further configured to randomly select the first scripted scenario.

17. The electronic gaming system of claim 15, wherein the server processor is further configured to select the first scripted scenario in a predetermined pattern.

18. The electronic gaming system of claim 15, wherein the server processor is further configured to select a second scripted scenario from the plurality of scripted scenarios based on the key value and a second wager amount where the first scripted scenario is a non-selectable option based on the second wager amount being utilized.

19. The electronic gaming system of claim 15, wherein the server processor is further configured to display a presentation based on the first scripted scenario.

20. The electronic gaming system of claim 15, wherein the server processor is further configured to display a themed presentation based on the first scripted scenario.

* * * * *